US008105103B2

(12) United States Patent
Nishio et al.

(10) Patent No.: US 8,105,103 B2
(45) Date of Patent: Jan. 31, 2012

(54) GROUND CONNECTING DEVICE AND WIRE HARNESS HAVING THE SAME

(75) Inventors: Akihiro Nishio, Yokkaichi (JP); Hiroki Hirai, Yokkaichi (JP); Tetsuji Tanaka, Yokkaichi (JP); Yasuo Omori, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 13/111,487

(22) Filed: May 19, 2011

(65) Prior Publication Data

US 2011/0294317 A1 Dec. 1, 2011

(30) Foreign Application Priority Data

May 28, 2010 (JP) ..... 2010-122305

(51) Int. Cl.
*H01R 13/28* (2006.01)

(52) U.S. Cl. ..... 439/287

(58) Field of Classification Search ..... 439/92, 439/287, 868, 883, 541.5
See application file for complete search history.

(56) References Cited

U.S. PATENT DOCUMENTS 5,759,055 A * 6/1998 Colantuano et al. ..... 439/287
6,086,399 A 7/2000 Matsunaga et al.

FOREIGN PATENT DOCUMENTS

JP A 10-208815 8/1998

* cited by examiner

*Primary Examiner* — Tho D Ta
(74) *Attorney, Agent, or Firm* — Oliff & Berridge, PLC

(57) ABSTRACT

Provided are a ground connecting device occupying only a little space and a wire harness having the ground connecting device. The ground connecting device comprises first and second ground joint connectors to connect a plurality of first and second grounding wires included in a wire harness to a ground site. The first ground joint connector includes a plurality of first wire terminals to be attached to respective terminal ends of the first grounding wires and a first ground conductor having a first ground-side terminal portion and a first connector housing which holds the first ground conductor. The second ground joint connector includes a plurality of wire terminals to be attached to respective terminal ends of the second remaining grounding wires, and a second ground conductor having a second ground-side terminal portion, and a second connector housing which holds the second ground conductor. The first and second connector housings are stacked above a wall surface while the ground-side terminal portions of the first and second ground conductors are stacked.

8 Claims, 14 Drawing Sheets

GROUND CONNECTING DEVICE AND WIRE HARNESS HAVING THE SAME

BACKGROUND OF THE INVENTION

1. Field of the Invention

The present invention relates to a technique applicable to a wire harness for a vehicle to connect a plurality of grounding wires included in the wire harness collectively to a given ground site inside the vehicle.

2. Description of the Related Art

Heretofore, as a ground connecting device for collectively connecting a plurality of grounding wires included in a wire harness for a vehicle to a ground site of the vehicle, there has been known one type described in JP 10-208815A.

FIG. 14 shows an outline of this device. The device comprises a harness-side connector 207 and a ground joint connector 201. The harness-side connector 207 is provided at a terminal end of a wire harness including a plurality of grounding wires, while the ground joint connector 201 is fixed to a given ground site (in FIG. 14, a bolt 206) provided to a vehicle body 203. The harness-side connector 207 includes a plurality of non-illustrated female terminals to be attached to respective terminal ends of the grounding wires and a connector housing 208 collectively holding the female terminals, the harness-side connector housing 208 having a plurality of terminal locking portions therein, each of the terminal locking portions adapted to hold a corresponding one of the female terminals. The ground joint connector 201 includes a grounding conductor 205 and a connector housing 202 which holds the grounding conductor 205. The grounding conductor 205 integrally has a grounding terminal portion 204 fixed to the ground site and a plurality of non-illustrated male terminals provided inside the connector housing 202.

This device is capable of interconnecting the ground joint connector 201 and the harness-side connector 207 and fixing the grounding terminal portion 204 of the ground joint connector 201 to the bolt 206 serving as the ground site, thereby achieving a collective connection of the grounding wires to the ground site. More specifically, each of the female terminals held in the connector housing 208 of the harness-side connector 207 can be fitted to a corresponding one of the male terminals of the grounding conductor 205 held in the connector housing 202 of the ground joint connector 201, thus electrically connecting the grounding wires to which the female terminals are attached to the ground site through the female terminals and the grounding conductor 205; simultaneously, the connector housing 208 of the harness-side connector 207 and the connector housing 202 of the ground joint connector 201 are fitted to each other, and this fitting is locked by engagement between respective engagement portions provided in the two connector housings 208 and 202, so that the fitness of each of the female terminals and the male terminals is maintained.

However, the ground connecting device has a problem of poor usability in a narrow space inside a vehicle, because of its large occupancy space. Specifically, the device requires a structure for fitting the connector housings 208 and 202, the structure increasing a size of the entire device: in detail, each of the harness-side connector 207 and the ground joint connector 201 are individually needed for holding the terminals, and the two connector housings 208 and 202 are required to be interconnected and locked to hold the fitness of the terminals of the connectors 207 and 201. In order to avoid interference between the vehicle body 203 and each of the connector housings 208 and 202, the connectors 207 and 201 are required to greatly project from an inner surface of a vehicle body 203.

Besides, in the case of collectively connecting two or more wire harnesses each including a plurality of grounding wires to a common ground site, the connecting requires two or more sets of the connector housings 208 and 202 for the respective wire harnesses to be arranged side-by-side around the ground site, which enlarges the occupancy space of the device.

In addition, if there is another grounding terminal 209, as shown in FIG. 14, which is attached to an extra grounding wire W and is to be superimposed and electrically connected to the grounding terminal portion 204, the gap size L between the vehicle body 203 and each of the connector housings 208 and 202 has to be increased as shown in FIG. 14 to avoid interference between the grounding terminal 209 and each of the connector housings 208 and 202, which further enlarges the occupancy space of the entire device.

SUMMARY OF THE INVENTION

It is an object of the present invention to provide a ground connecting device occupying only a little space while comprising a ground joint connector for connecting a wire harness to a ground site, and provide a wire harness having the ground connecting device.

Specifically, the present invention provides a ground connecting device for collectively connecting a group of grounding wires to a ground site provided in a wall surface inside a vehicle. The ground connecting device comprises a first ground joint connector to be provided at terminal ends of a plurality of first ones of the grounding wires and a second ground joint connector to be provided at terminal ends of a plurality of second ones of the remaining grounding wires.

The first ground joint connector comprises: a plurality of first wire terminals to be attached the terminal ends of the first grounding wires respectively; a first grounding conductor which includes a plurality of first wire-side terminal portions each having a shape capable of being fitted to a corresponding one of the first wire terminals in a specific terminal fitting direction common to the first wire terminals, and a first ground-side terminal portion having a shape capable of being connected to the ground site on the wall surface, the first wire-side terminal portions being aligned in a direction approximately perpendicular to the terminal fitting direction and approximately parallel to the wall surface and integrally joined to the first ground-side terminal portion and; a first connector housing which holds the first grounding conductor, the first connector housing including a plurality of terminal receiving chambers and a plurality of terminal locking portions. Each of the terminal receiving chambers has an opening oriented in one direction parallel to the terminal fitting direction and receives the first wire terminals inserted through the opening thereof. Each of the terminal locking portions is adapted to lock the first wire terminal inserted into a corresponding one of the terminal receiving chambers. The first connector housing receives the first wire-side terminal portions in the terminal receiving chambers respectively so as to allow each of the terminal locking portions to lock a corresponding one of the first wire terminals which are inserted into the receiving chambers and fitted with the first wire-side terminal portions respectively, and holds the first grounding conductor in such a manner that the first ground-side terminal portion protrudes outside the first connector housing on a side opposite to the openings of the terminal receiving chambers of the first connector housing.

The second ground joint connector comprises: a plurality of second wire terminals to be attached the terminal ends of the second grounding wires respectively; a second grounding conductor which includes a plurality of second wire-side terminal portions each having a shape capable of being fitted to a corresponding one of the second wire terminals in a specific terminal fitting direction common to the second wire terminals, and a second ground-side terminal portion having a shape capable of being connected to the ground site on the wall surface, the second wire-side terminal portions being aligned in a direction approximately perpendicular to the terminal fitting direction and approximately parallel to the wall surface and integrally joined to the second ground-side terminal portion and; a second connector housing which holds the second grounding conductor, the second connector housing including a plurality of terminal receiving chambers and a plurality of terminal locking portions. Each of the terminal receiving chambers has an opening oriented in one direction parallel to the terminal fitting direction so that each of the second wire terminals can be inserted into a corresponding one of the terminal receiving chambers through the opening thereof. Each of the terminal locking portions is adapted to lock the second wire terminal inserted into a corresponding one of the terminal receiving chambers. The second connector housing receives the second wire-side terminal portions in the terminal receiving chambers respectively so as to allow each of the terminal locking portions to lock a corresponding one of the second wire terminals which are inserted into the receiving chambers and fitted with the second wire-side terminal portions respectively, and holds the second grounding conductor in such a manner that the second ground-side terminal portion protrudes outside the second connector housing on a side opposite to the openings of the terminal receiving chambers of the second connector housing.

The second ground-side conductor and the second connector housing have respective shapes of allowing the second grounding conductor and the first grounding conductor to be stacked onto each other, under a condition that a first alignment direction of the first wire-side terminal portions and a second alignment direction of the second wire-side terminal portions are approximately parallel to each other, in a stacking direction perpendicular to both of the alignment directions and allowing the first connector housing and the second connector housing to be stacked onto each other in the stacking direction in a state that the first grounding conductor and the second grounding conductor are stacked onto each other.

This ground connecting device comprises the first and second ground joint connectors which enable a plurality of wire harnesses to be connected to a common ground site, while occupying only a limited space. Besides, the device allows a resistance between each of the grounding wires in the wire harness and the ground site to be reduced, thus ensuring excellently grounding.

DESCRIPTION OF THE PREFERRED EMBODIMENTS

Figure 1:
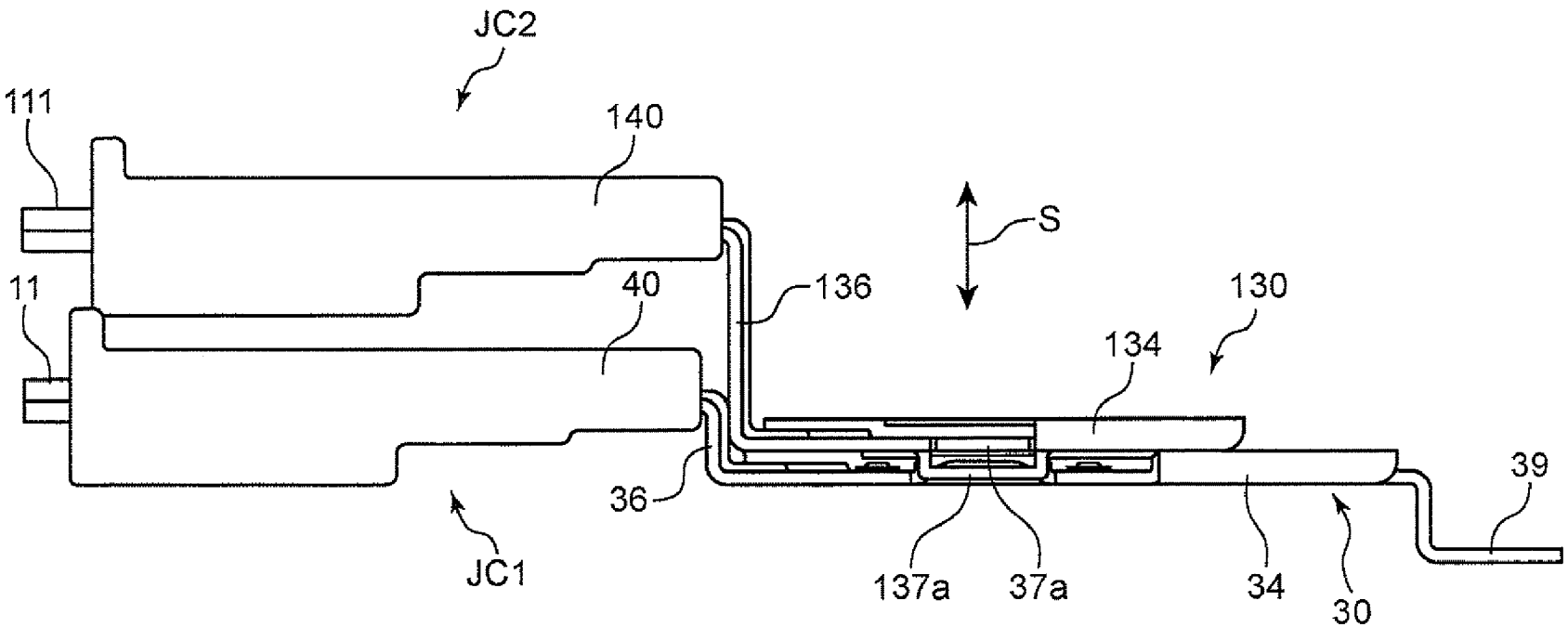
FIG. 1 is a front view showing a ground connecting device at a terminal end of a wire harness according to a first embodiment of the present invention.
Figure 2:
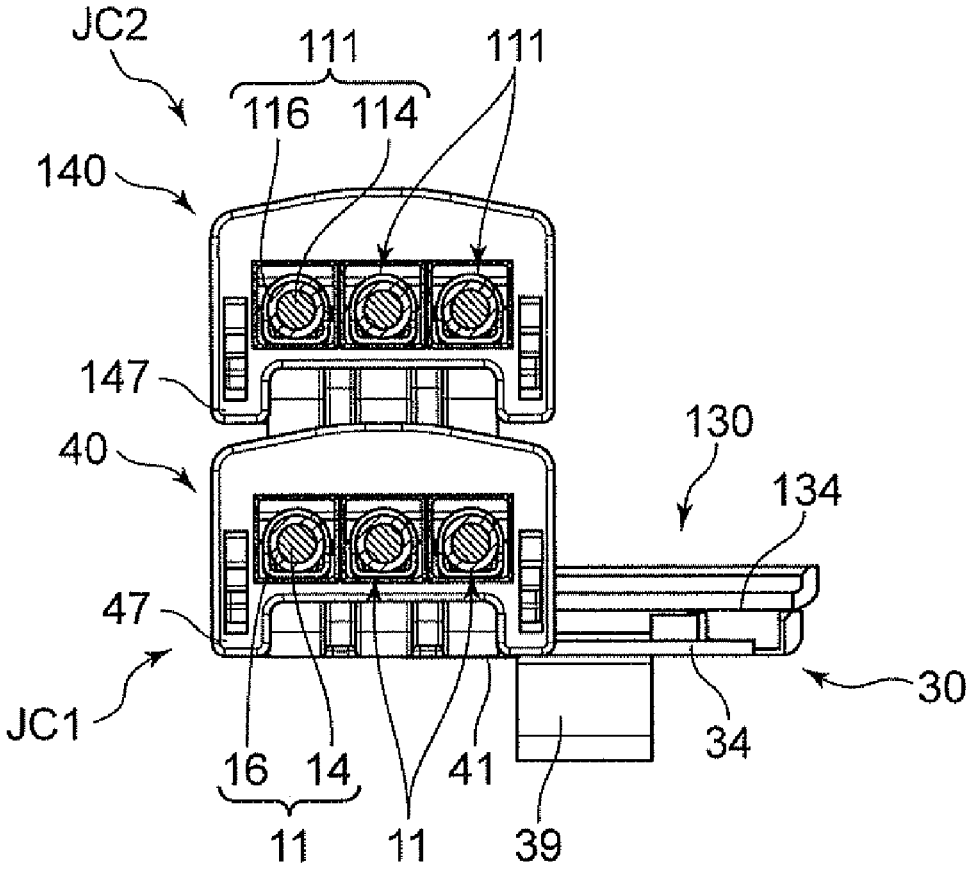
FIG. 2 is a side view of the ground connecting device in FIG. 1, when viewed from the side of grounding wires.
Figure 3:
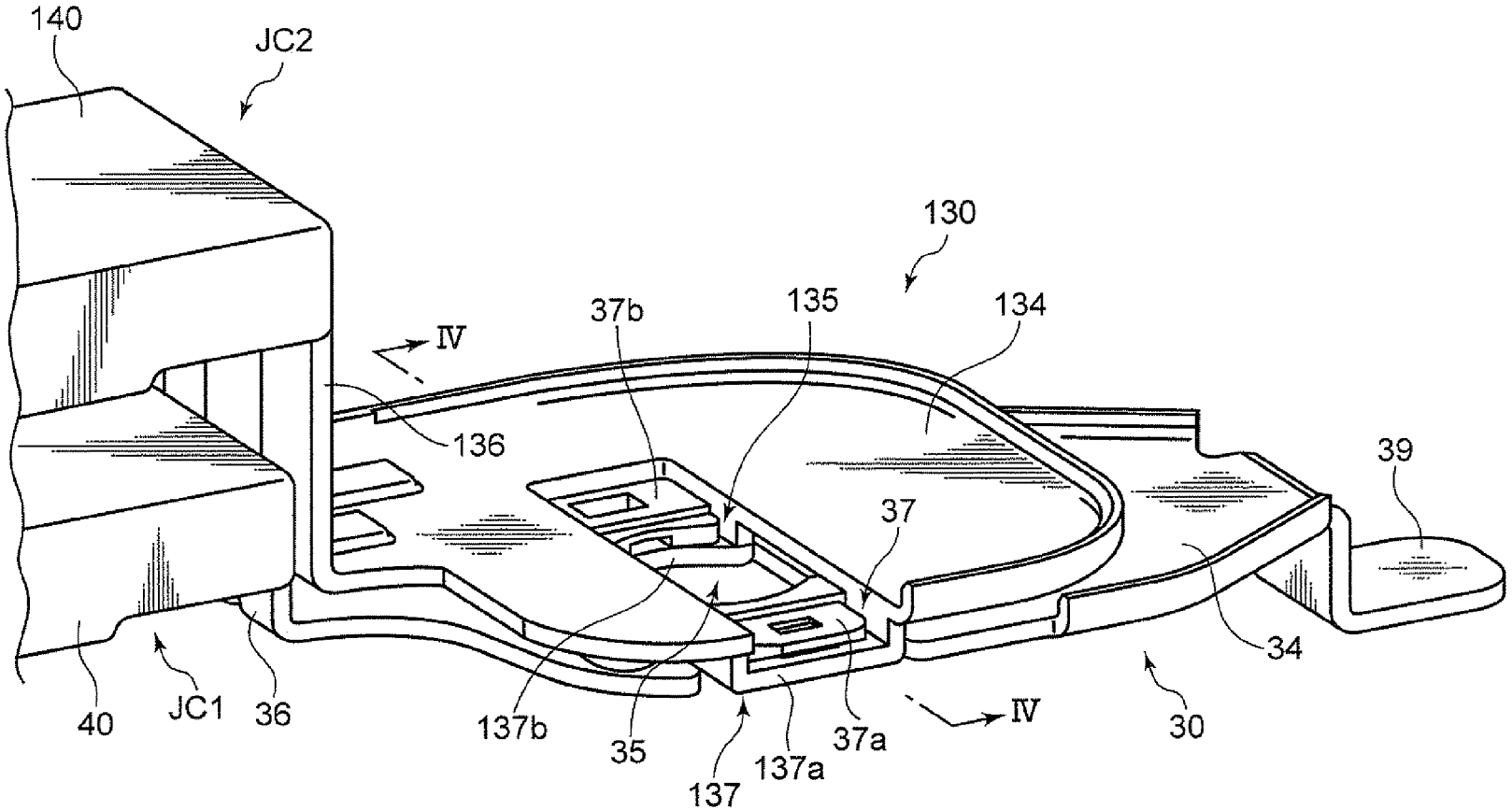
FIG. 3 is an enlarged perspective view of a ground-side terminal and other members in vicinity thereof in FIG. 1.

There will be described a ground connecting device of the present invention and a wire harness having the ground connecting, based on preferred embodiments thereof, with reference to the drawings.

FIGS. 1 to 5 show a wire harness according to a first embodiment of the present invention. The wire harness comprises a wire harness body including a plurality of electric wires bundled together and a ground connecting device connected to a terminal end of the wire harness body.

The wire harness body includes a first wire harness body comprised of a plurality of first grounding wires 11, and a second wire harness body comprised of a plurality of second grounding wires 111. Each of the first grounding wires 11 has a conductor 14 and an insulating sheath 16 covering the conductor 14. Similarly, each of the second grounding wires 111 has a conductor 114 and an insulating sheath 116 covering the conductor 114. The first and second grounding wires 11 and 111 can be collectively connected to a common ground site on an after-mentioned wall surface WS of a vehicle through the ground connecting device.

Figure 5:
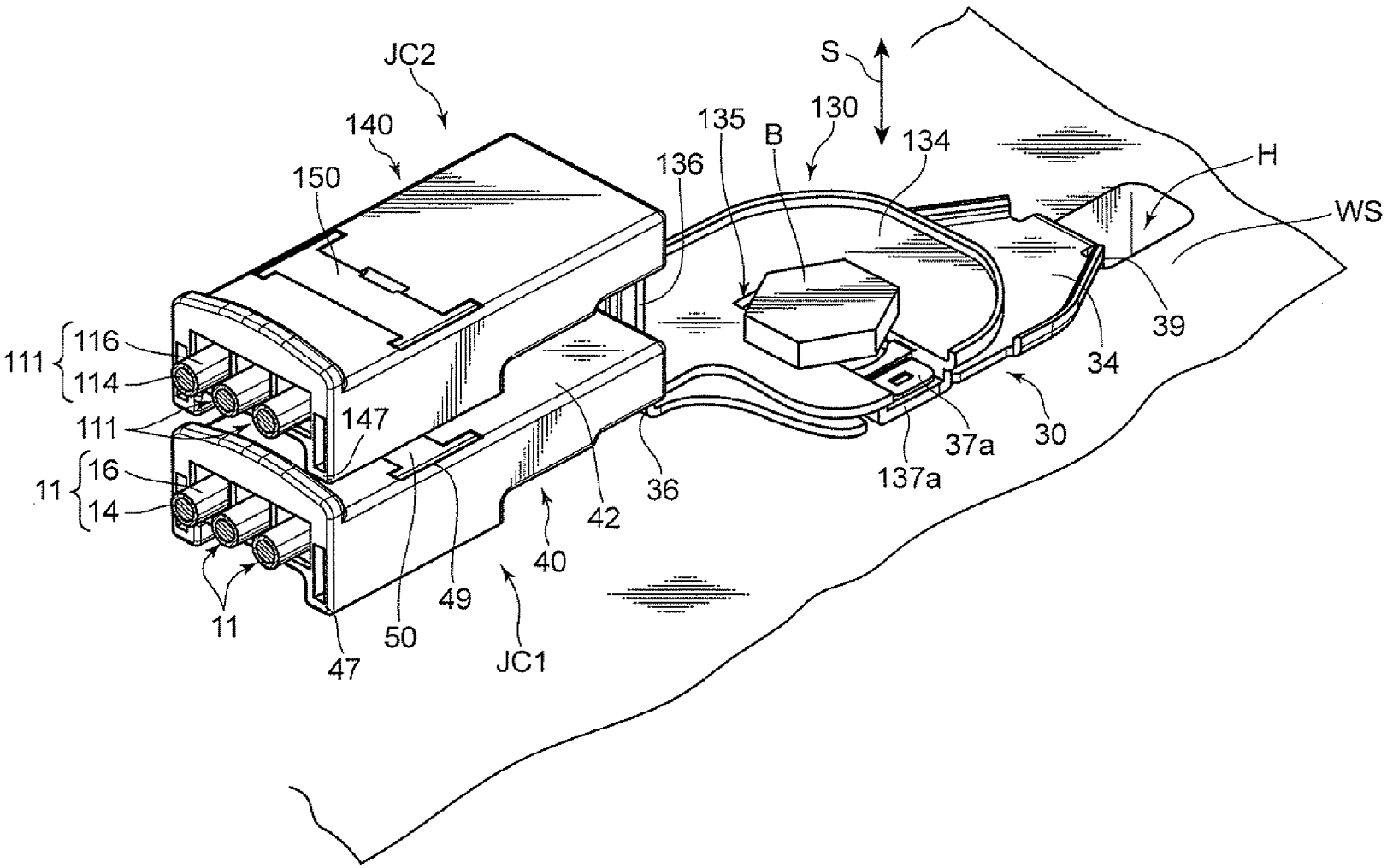
FIG. 5 is a perspective view showing the ground connecting device in FIG. 1 having been attached to a ground site of a vehicle.

The ground site comprises a part of a wall surface WS of a vehicle body, and a bolt B provided to protrude inwardly from the wall surface WS, as shown in FIG. 5. Specifically, each of the grounding wires 11 and 111, which is designed to ground a specific circuit connected to the wire harness to the ground site, has one end to be connected to the bolt B of the ground site and the other end to be connected to the circuit.

The ground connecting device includes a first ground joint connector JC1 and a second ground joint connector JC2, which are disposed on a lower side and on an upper side, respectively, and superimposed on each other. The first and second ground joint connectors JC1 and JC2 are designed to correlatively connect, to the common ground site, a group of the first grounding wires 11 constituting the first wire harness body and a group of the second grounding wires 111 constituting the second wire harness body, respectively.

Specifically, the first ground joint connector JC1 comprises a plurality of first wire terminals 20 (see FIG. 6B), a first connector housing 40 and a retainer 50; the second joint connector JC2 comprises a plurality of second wire terminals 120 (see FIG. 6B), a second connector housing 140 and a retainer 150. The first ground joint connector JC1, namely the lower connector, further comprises a first grounding conductor 30, and the second joint connector JC2, namely the upper connector, further comprises a second grounding conductor 130.

Except the first and second grounding conductors 30 and 130, the first and second ground joint connectors JC1 and JC2 comprises the same components. For this reason, the first ground joint connector JC1 will be mainly and representatively described in detail below.

Figure 6A:
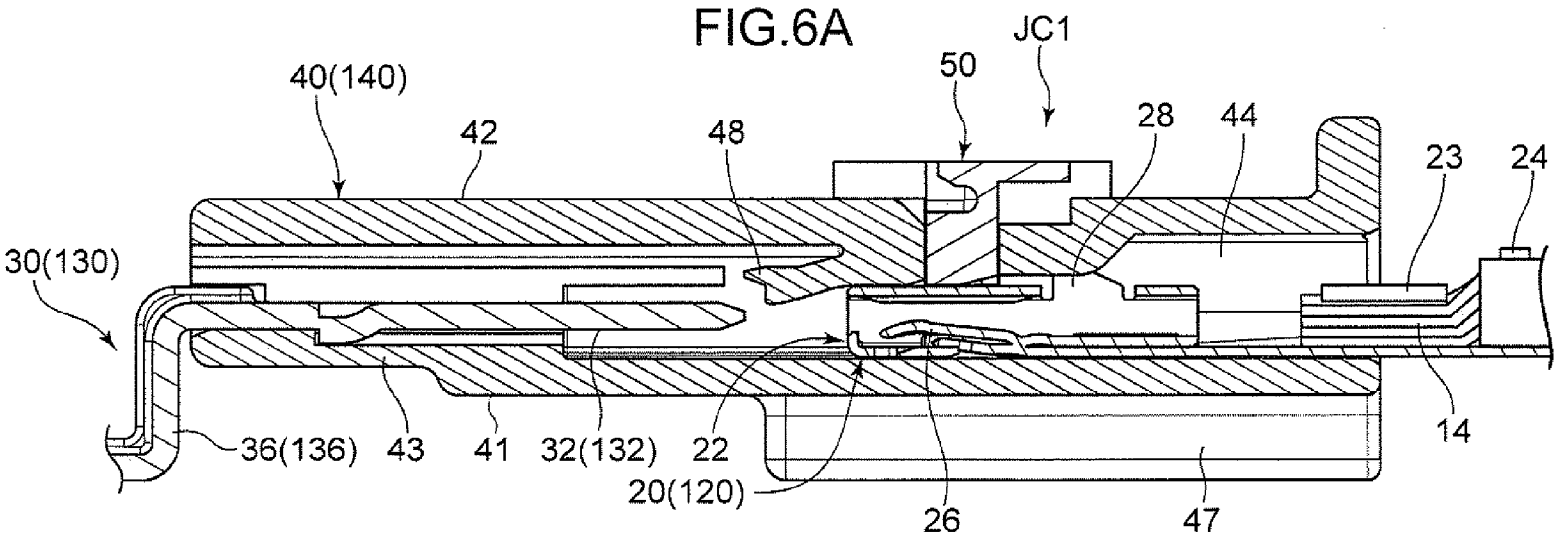
FIG. 6A is a sectional front view showing a retainer of a ground joint connector of the ground connecting device in FIG. 1, the retainer located in a release position.
Figure 6B:
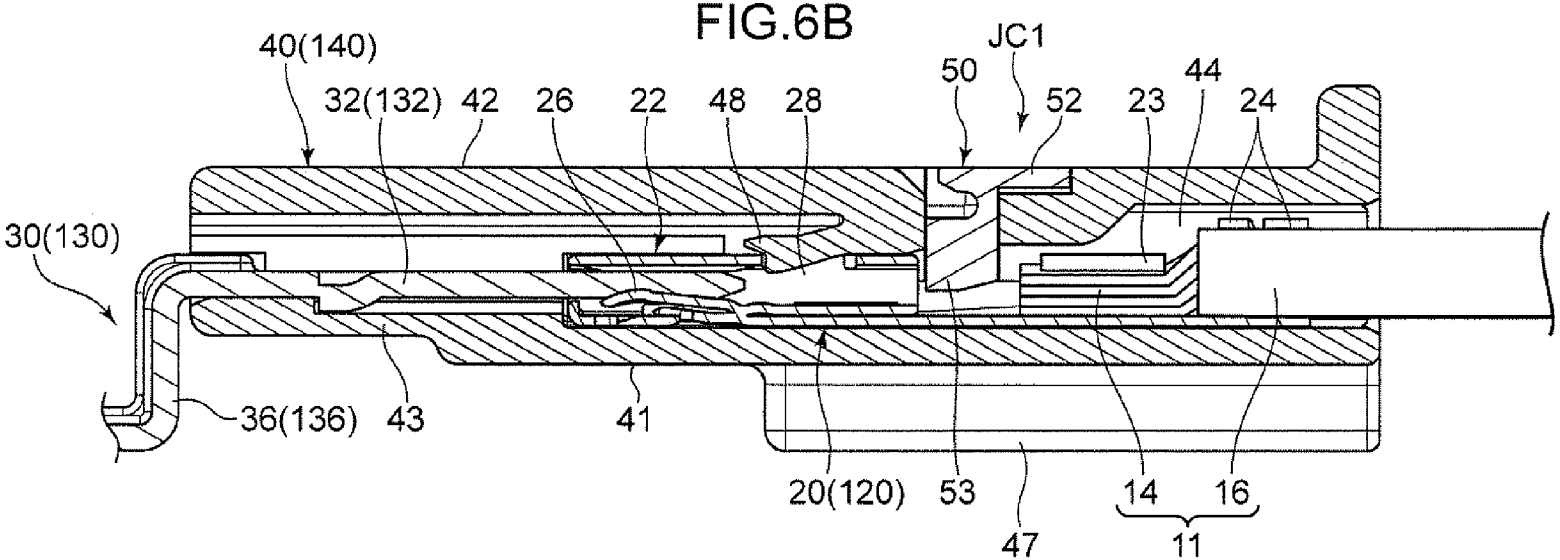
FIG. 6B is a sectional front view showing the retainer located in a locking position.

The first wire terminals 20 are designed to be provided at respective terminal ends of the first grounding wires 11, each including a female-type electric contact portion 22, and a wire-side fixed portion constituted by a conductor barrel 23 and an insulation barrel 24 on front and rear sides respectively, as also shown in FIGS. 6A and 6B. The electric contact portion 22 has a hollow rectangular cylindrical-shaped contact body and a contact spring 26 provided inside the contact body and allowed to be deflected. The contact body has a top wall, a pair of sidewalls and a bottom wall. The top wall is formed with a lockable hole 28 adapted to be locked to the first connector housing 40.

The wire-side fixed portion is crimped onto the terminal end of a corresponding one of the first grounding wires 11. In the terminal end of each of the first grounding wires 11, the insulating sheath 16 is partially removed to expose the conductor 14. The barrels 23 and 24 constituting the wire-side fixed portion are so bended as to enfold a terminal end of the conductor 14 and a portion of the insulating sheath 16 adjacent thereto, respectively, thereby crimped onto the terminal end of the first grounding wire 11. This crimping brings the conductor barrel 23 into electrical connection with the conductor 14.

The first grounding conductor 30, which is made of an electrical conductive material, is connected to the first wire terminals 20 in a shared manner, to thereby collectively connect the first wire terminals 20 to the bolt B of the ground site, i.e., to the ground. The entire first connector housing 40 is integrally molded of an insulating material such as a synthetic resin into a shape which is capable of holding a given region of the first grounding conductor 30 and housing it while being flat in a thickness direction of the first grounding conductor 30.

Figure 7:
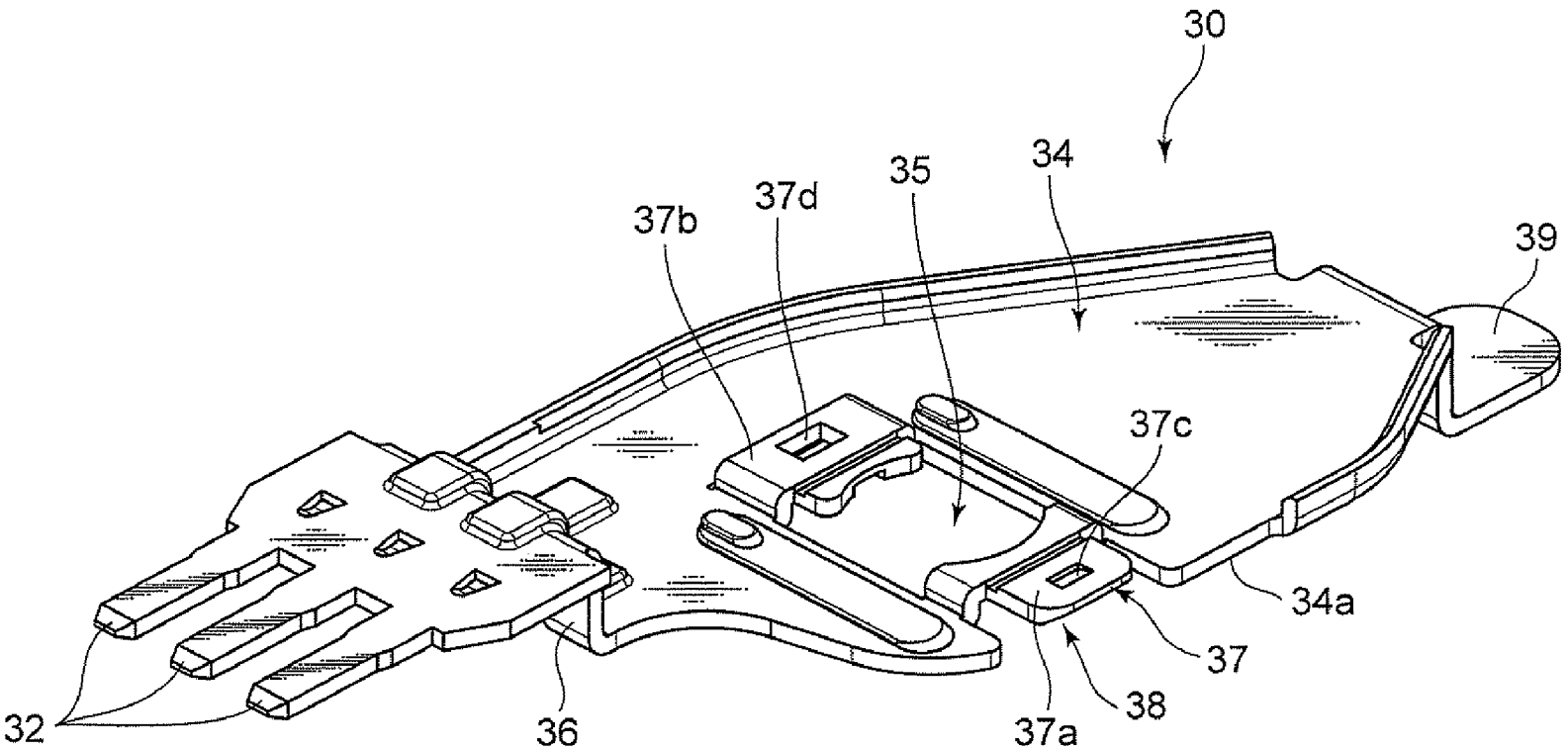
FIG. 7 is perspective view showing a ground conductor in FIG. 1.
Figure 8:
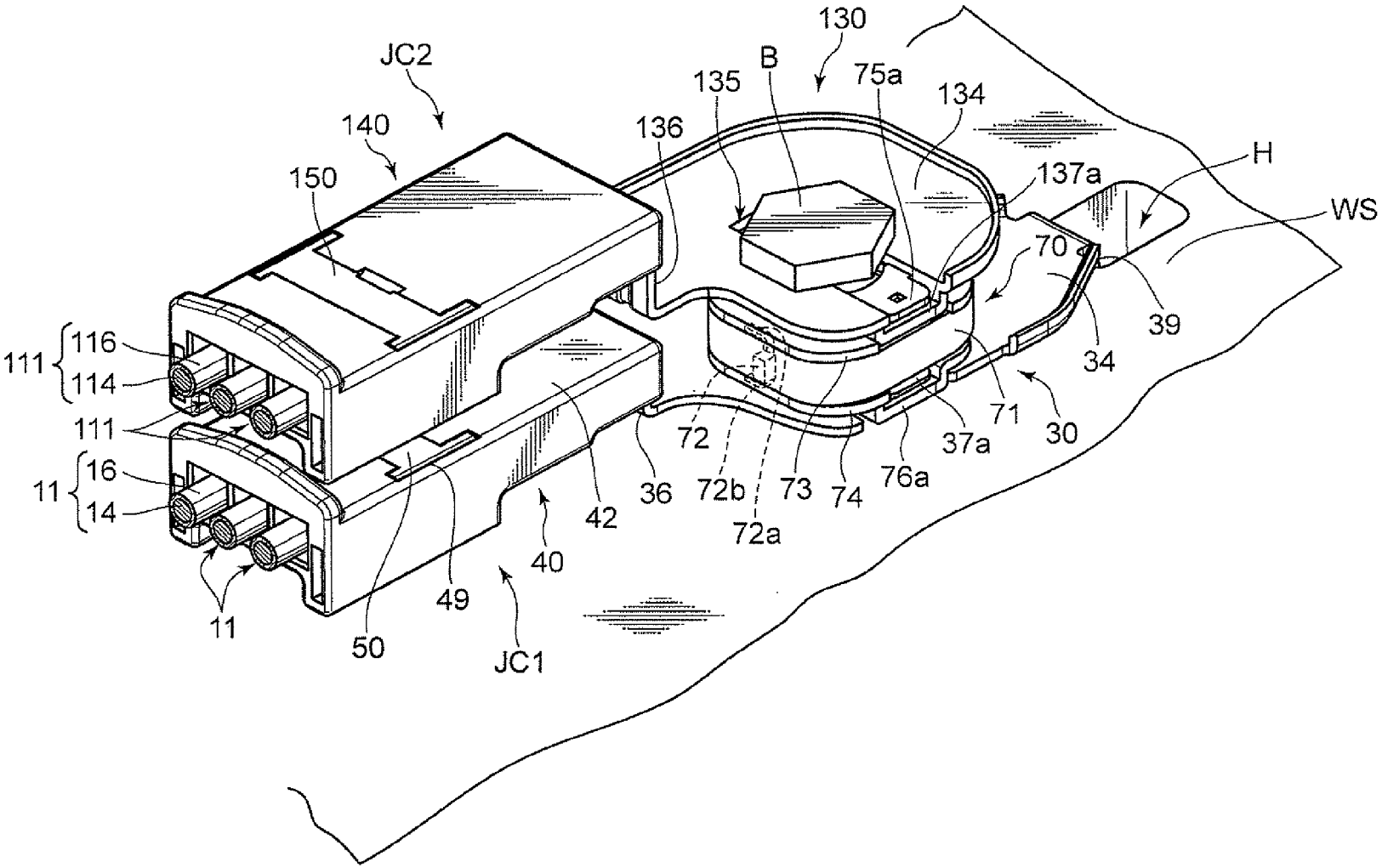
FIG. 8 is a perspective view showing a ground connecting device according to a second embodiment of the present invention.
Figure 9:
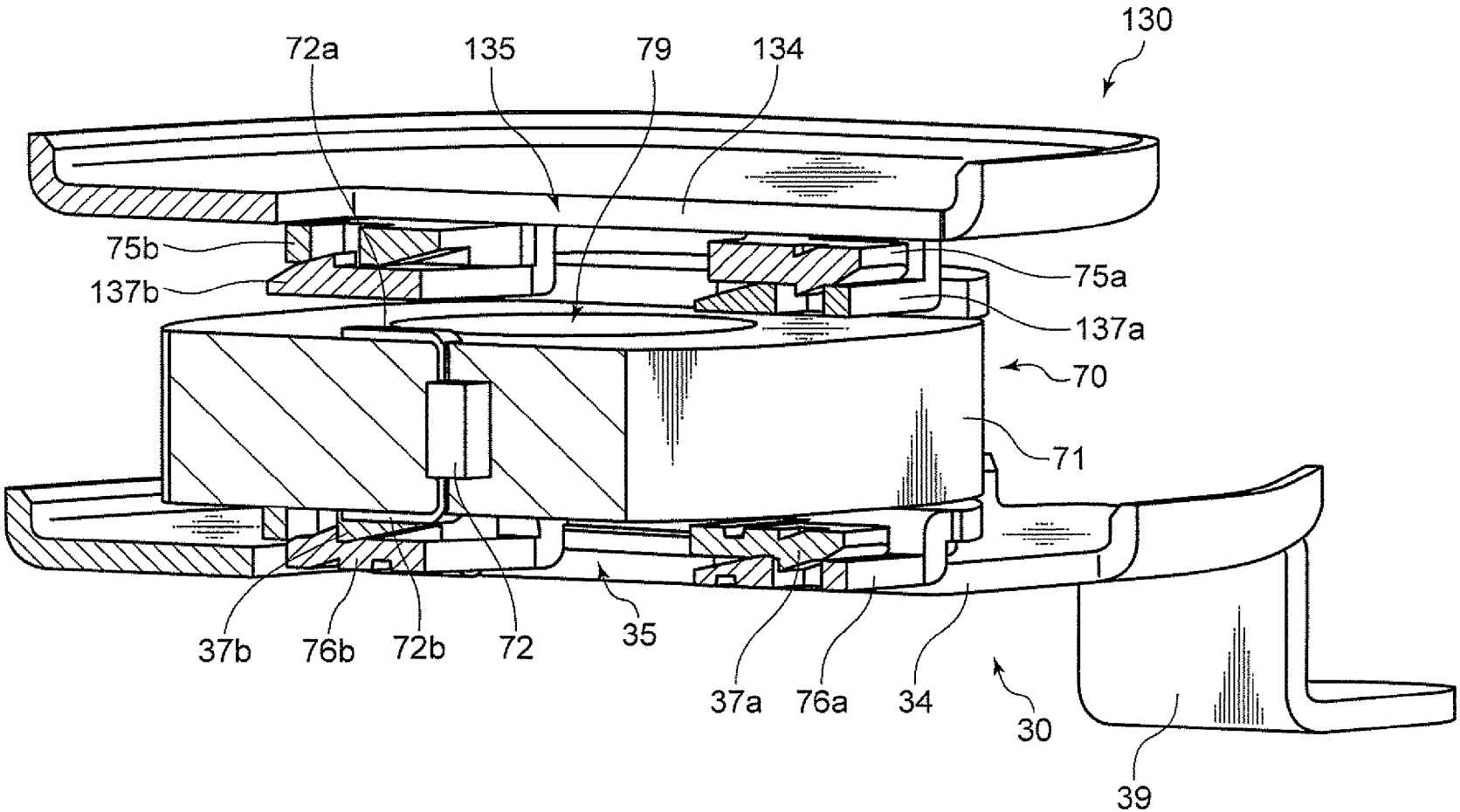
FIG. 9 is a cut-out perspective view showing a connection area for an electronic component in FIG. 8.
Figure 10:
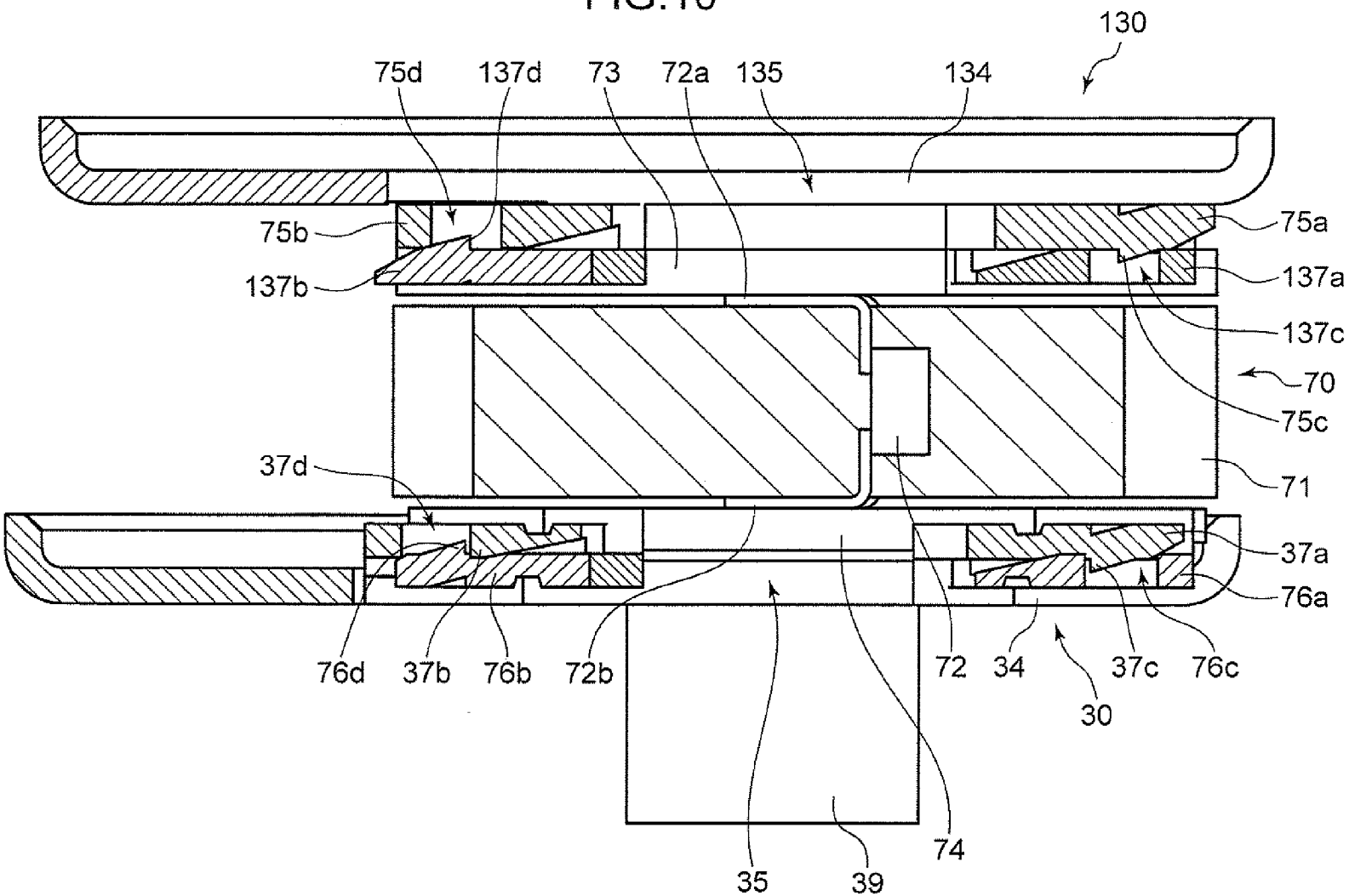
FIG. 10 is a sectional explanatory diagram showing the connection area for the electronic component in FIG. 8.

The first grounding conductor 30 is formed by punching a single metal plate into an appropriate shape and bending an appropriate region of the punched-out plate. As also shown in FIG. 7, the first grounding conductor 30 integrally has a plurality of (in the illustrated embodiment, three) first wire-side terminal portions 32, a first ground-side terminal portion 34, and a first stepped portion 36 extending in an upward-downward direction at a position between the first ground-side terminal portion 34 and each of the wire-side terminal portions 32. Each of the first wire-side terminal portions 32 is continued with the common, first ground-side terminal portion 34 through the first stepped portion 36.

Each of the first wire-side terminal portions 32 is formed to protrude toward a rear side (wire side) of the first ground joint connector JC1 to serve as a male-type fitting portion (tab) fittable to the female-type electric contact portion 22 of a corresponding one of the first wire terminals 20 in a given terminal fitting direction (an axial direction of each of the first grounding wires 11), and adapted to make press contact with the contact spring 26 and the top wall of the electric contact portion 22, when fitted with the first wire terminal 20, and thereby electrically conducted to the electric contact portion 22. The first wire-side terminal portions 32 are aligned in a direction parallel to a width direction thereof (a direction perpendicular to the terminal fitting direction and parallel to the wall surface WS). The first stepped portion 36 couples each of the first wire-side terminal portions 32 and the first ground-side terminal portion 34 located on a front side of the first wire-side terminal portions 32 together, while providing a given step between the first ground-side terminal portion 34 and an arrangement plane of the first wire-side terminal portions 32.

The second grounding conductor 130 integrally has a plurality of second wire-side terminal portions 132 each having the same shape as that of the first wire-side terminal portion 32, a second ground-side terminal portion 134 having the same shape as that of the ground-side terminal portion 34, and a second stepped portion 136 extending in the upward-downward direction at a position between the second ground-side terminal portion 134 and each of the second wire-side terminal portions 132. The second stepped portion 136 has a vertical size greater than that of the first stepped portion 36.

The first ground-side terminal portion 34 is adapted to be fixed onto the wall surface WS while being connected to the bolt B of the ground site, while having a function of holding the second ground-side terminal portion 134 of the upper, second ground joint connector JC2. Specifically, the first ground-side terminal portion 34 has a plate-like shape along the wall surface WS, including a fixing surface 34*a*, which is a planar surface fixable onto the wall surface WS, on the back side thereof.

The first and second ground-side terminal portions 34 and 134 are formed with respective through-holes 35 and 135 into each of which the bolt B can be inserted at an appropriate position thereof; the position, in the illustrated embodiment, is offset from the first wire-side terminal portions 32 in a width direction parallel to an alignment direction of the first wire-side terminal portions 32). The first ground-side terminal portion 34 also has two first engagement members 37*a* and 37*b* formed on respective right and left sides (widthwise opposite sides) of the through-hole 35 to constitute a first contact section 37. The second ground-side terminal portion 134 also has two second engagement members 137*a* and 137*b* formed on respective right and left sides (widthwise opposite sides) of the through-hole 135 to constitute a second contact section 137. The second engagement members 137*a* and 137*b* are engageable with the first engagement members 37*a* and 37*b*, respectively.

The first engagement member 37*a* is raised upwardly (toward an obverse side) with respect to the remaining section of the first ground-side terminal portion 34 to form, on an under side (back side) thereof, a space 38 (FIG. 7) for receiving the second ground-side terminal portion 134 to be fitted thereinto. The first engagement member 37*b* has a shape raised upwardly with respect to an upper surface of the remaining section of the first ground-side terminal portion 34, having a body wall parallel to the upper surface and above the upper surface. Besides, the first ground-side terminal portion 34 has an anti-rotation tongue piece 39 extending downwardly from an end of the first ground-side terminal portion 34. The anti-rotation tongue piece 39 can be fitted into a hole H formed in the wall surface WS to thereby restrict a rotation of the first ground joint connector JC1 about the bolt B.

The first connector housing 40 holds the first wire-side terminal portions 32 so as to expose the first ground-side terminal portion 34 of the first grounding conductor 30, and has a flat shape with respect to a direction perpendicular to the alignment direction of the first wire-side terminal portions 32. Simultaneously, the second connector housing 140 holds the second wire-side terminal portions 132 so as to expose the second ground-side terminal portion 134 of the second grounding conductor 130, and has a flat shape with respect to a direction perpendicular to the alignment direction of the second wire-side terminal portions 132.

The first connector housing 40 has a reverse side surface 41 which is faced to the wall surface WS when the first ground-side terminal portion 34 is fixed to the wall surface WS, and an obverse side surface 42 on an opposite side of the reverse surface 41. In this embodiment, either of the two surfaces 41 and 42 is a flat surface approximately parallel to the wall surface WS. The reverse surface 41 has a plurality of line-shaped protrusions 47 protruding outward, each of which has a protruding amount enough to form a gap corresponding to the first stepped portion 36 between the reverse surface 41 and the wall surface WS.

As shown in FIGS. 6A and 6B, the first connector housing 40 has a front portion (a ground-side portion) and is formed as a conductor holding portion 43, and a rear portion (a wire-side portion) including a plurality of (in the illustrated embodiment, three) terminal receiving chambers 44. The terminal receiving chambers 44 are aligned parallel to the alignment direction of the first wire-side terminal portions 32 at the same pitch as that of the first wire-side terminal portions 32. Each of the terminal receiving chambers 44 has an opening on the rear side, i.e., on a side opposite to the first ground-side terminal portion 34, allowing the electric contact portion 22 of each of the first wire terminals 20 to be inserted into the terminal receiving chambers 44 through the opening. The conductor holding portion 43 has a shape of permitting the first wire-side terminal portions 32 of the first grounding conductor 30 to be press-fitted into the conductor holding portion 43 from a side opposite to the terminal receiving chambers 44 (the front side), and is adapted to hold the press-fitted first the wire-side terminal portions 32. Each of the first wire-side terminal portions 32 is held in a position where the first wire-side terminal portions 32 protrude into the terminal receiving chambers 44 respectively and are fittable with the respective electric contact portions 22 of the first wire terminals 20 inserted into the terminal receiving chambers 44 respectively, in an insertion direction of the first wire terminal 20 (that is, terminal fitting direction).

As shown in FIGS. 6A and 6B, the first connector housing 40 is formed with a plurality of lances 48 each serving as a terminal locking portion, at respective positions corresponding to the terminal receiving chambers 44. Each of the lances 48 extends obliquely inwardly from a top surface (upper surface) of a corresponding one of the terminal receiving chambers 44, having a distal end which is capable of being deflected in a thickness direction of the first connector housing 40 (that is, a vertical direction in FIGS. 6A and 6B). The distal end is adapted to be upwardly deflected by the inserted first wire terminal 20 so as to permit the first wire terminal 20 to pass therethrough, and, thereafter, elastically return to its regular position to thereby fall into the lockable hole 28 of the first wire terminal 20 as shown in FIG. 6B so as to restrain the first wire terminal 20 from the rear side. In other words, the distal end prevents the first wire terminal 20 from a displacement in the removal direction to thereby lock (primarily lock) the first wire terminal 20 in a position of fitting with the first wire-side terminal portion 32.

The retainer 50 is designed for additionally locking (secondarily locking) the first wire terminals 20 which are fitted to the first wire-side terminal portions 32 and primarily locked by the respective lances 48. The retainer 50 is mounted to an intermediate portion of the first connector housing 40 in a frontward-rearward direction. Specifically, the retainer 50 is attached to the first connector housing 40 so as to be movable, in a thickness direction of the first connector housing 40 (in a direction approximately perpendicular to both of the alignment direction of the first wire-side terminal portions 32 and the terminal fitting direction), between a release position shown in FIG. 6A and a locking position of sinking into the first connector housing 40 compared with the release position, as shown in FIG. 6B. In the release position, the retainer 50 allows the first wire terminals 20 to be inserted into and removed from their respective terminal receiving chambers 44; in the locking position, the retainer 50 locks each of the first wire terminals 20 in a position where the first wire terminals 20 is inserted into its terminal receiving chambers 44 and fitted to a corresponding one of the first wire-side terminal portions 32.

As shown in FIGS. 5, 6A and 6B, the retainer 50 integrally has a top wall 52 extending widthwise of the first connector housing 40 (parallel to the alignment direction of the first wire-side terminal portions 32), and a pair of side walls extending downwardly from opposite ends of the top wall 52 so as to be inserted into respective insertion grooves 49 of the first connector housing 40, being attached to the first connector housing 40 so as to be relatively displaceable in the vertical direction to the first connector housing 40.

The top wall 52 is formed with a plurality of locking protrusions 53 each protruding from a reverse surface of the top wall 52 at a position corresponding to the respective terminal receiving chambers 44. When the retainer 50 is in the release position, the locking protrusions 53 are retracted upwardly (toward the obverse side) from their respective terminal receiving chambers 44 to thereby permit the respective first wire terminals 20 to be inserted and removed; when the retainer 50 is pushed to the locking position under a condition that the first wire terminals 20 are inserted into their respective terminal receiving chambers 44 and locked by the respective lances 48, the locking protrusions 53 protrude into the terminal receiving chambers 44 to restrain the respective electric contact portions 22 of the first wire terminal 20 from their rear side, thus establishing double-lock of the first wire terminal 20.

The locking position of the retainer 50 is set to a position where an upper surface of the top wall 52 of the retainer 50 is flush with the obverse surface 42 of the first connector housing 40 as shown in FIG. 5 and FIG. 6B, or sinks into the first connector housing 40 (downwardly in FIG. 6B) beyond the obverse surface 42. On the other hand, the release position of the retainer 50 is set to a position where the top wall 52 protrudes outwardly (in FIG. 6A, upwardly) beyond the obverse surface 42 as shown in FIG. 6A.

The second ground joint connector JC2 has a structure common to the first ground joint connector JC1, except a size difference between the second stepped portion 136 and the first stepped portion 36 and a lack of the tongue piece 39. The first stepped portion 36 can be omitted, as long as the second stepped portion 136 has a length enough to allow the stack of the first and second connector housings 40 and 140.

The second grounding conductor 130 and the second connector housing 140 have respective shapes to allow the second grounding conductor 130 to be stacked on the first grounding conductor 30, in such a posture that the alignment direction of the first wire-side terminal portions 32 and the alignment direction of the second wire-side terminal portions 132 are approximately parallel to each other, in a stacking direction S perpendicular to the respective alignment directions, and allow the first connector housing 40 and the second connector housing 140 to be stacked onto each other in the stacking direction S in the stacked state of the first and second grounding conductors 30 and 130.

The second contact section 137 of the second ground-side terminal portion 134 are adapted to make contact with the first contact section 37 of the first ground-side terminal portion 34, when the first and second ground-side terminal portions 34 and 134 are stacked with respect to each other in the stacking direction S, thus electrically interconnecting the first and second ground-side terminal portions 34 and 134. The second engagement members 137*a* and 137*b*, which constitute the second contact section 137 and are located on both sides of the through-hole 135 into which the bolt B can be inserted, respectively, are adapted to engage with the first engagement members 37*a* and 37*b* respectively when the first and second grounding conductors 30 and 130 are stacked, to thus keep the first and second grounding conductors 30 and 130 stacked to each other.

The second stepped portion 136 of the second grounding conductor 130 extends in a direction parallel to the stacking direction S, at a position between the second ground-side terminal portion 134 and each of the second wire-side terminal portions 132, thus providing a step between the second ground-side terminal portion 134 and each of the second wire-side terminal portions 132, in the stacking direction S. The second stepped portion 136 has a size to enable the second connector housing 140 to be stacked on the first connector housing 40 when the second ground-side terminal portion 134 is stacked on the first ground-side terminal portion 34.

The second connector housing 140 has a plurality of line-shaped protrusions 147 protruding from a reverse surface thereof. Each of the line-shaped protrusions 147 has a protruding amount capable of coming contact with the obverse surface 42 of the first connector housing 40 in the stacked state. The contact allows the second connector housing 140 to be stable held.

The wire harness including the above ground connecting device can be connected to the ground site of the vehicle, for example, in the following procedure.

(1) Attachment of Wire Terminals

From two respective wire harness bodies, the first grounding wires 11 and the second grounding wires 111 to be grounded are extracted, and the first and second wire terminals 20 and 120 of the first and second ground joint connector JC1 and JC2 are attached to the terminal ends of the first and second grounding wires 11 and 111, respectively. The attachment may be performed in advance of assembling of the wire harness.

(2) Lock of Wire Terminals

As shown in FIG. 6A, the first and second wire terminals 20 and 120, in the first and second ground joint connectors JC1 and JC2, are inserted into their respective terminal receiving chambers 44 of the first and second connector housings 40 and 140 and fitted to the first and second wire-side terminal portions 32 and 132 of the first and second grounding conductors 30 and 130, respectively, while passing the respective locking protrusions 53 of the retainer 50 and 150 in the release position. This brings the first and second wire terminals 20 and 120 into a possibility of collective electrical connection to the common grounding conductor 30 and 130, respectively. During the above fitting operation, the respective lances 48, i.e., the terminal locking portions, of the first and second connector housings 40 and 140, are fitted into the lockable holes 28 provided in the electric contact portions 22 of the first and second wire terminals 20 and 120 respectively to primarily lock the electric contact portions 22, thereby keeping the electric contact portion 22 and the first and second wire-side terminal portions 32 and 132 fitted to each other respectively.

Furthermore, the respective retainers 50 and 150 of the first and second ground joint connector JC1 and JC2 are pushed in the thickness direction of the first and second connector housings 40 and 140 (i.e., in a direction perpendicular to both of the alignment direction of the first and second wire-side terminal portions 32 and 132 and the terminal fitting direction), respectively, and locked at their respective locking positions as illustrated in FIG. 6B. The retainers 50 and 150 thus brought into the locking position secondarily lock the first and second wire terminals 20 and 120 respectively; in detail, the locking protrusions 53 of the top walls 52 of the retainer 50 and 150 are moved into the respective terminal receiving chambers 44 to restrain the electric contact portions 22 of the first and second wire terminals 20 and 120 from the rear side thereof, respectively. This makes it possible to reliably keep the first and second wire terminals 20 and 120 fitted to the first and second wire-side terminal portions 32 and 132 respectively, inside the first and second connector housing 40 and 140, even though there is no extra wire terminal-holding housing other than the first and second connector housing 40 and 140 as in the conventional ground connecting device.

(3) Unitization of Upper and Lower Grounding Conductors 30 and 130

The first and second connector housings 40 and 140 of the first and second ground joint connectors JC1 and JC2 are vertically superimposed on each other. This involves an unitization of the first ground-side terminal portion 34 of the lower grounding conductor 30 and the second grounding-side terminal portion 134 of the upper grounding conductor 130, and an electrical interconnection thereof.

In the first embodiment, in order to integrally couple the first and second ground-side terminal portions 34 and 134 of the first and second ground joint connectors JC1 and JC2, the first engagement members 37*a* and 37*b* are provided in the first ground-side terminal portion 34, while the second engagement members 137*a* and 137*b* are provided in the second ground-side terminal portion 134 as the engagement counterparts.

Figure 4:
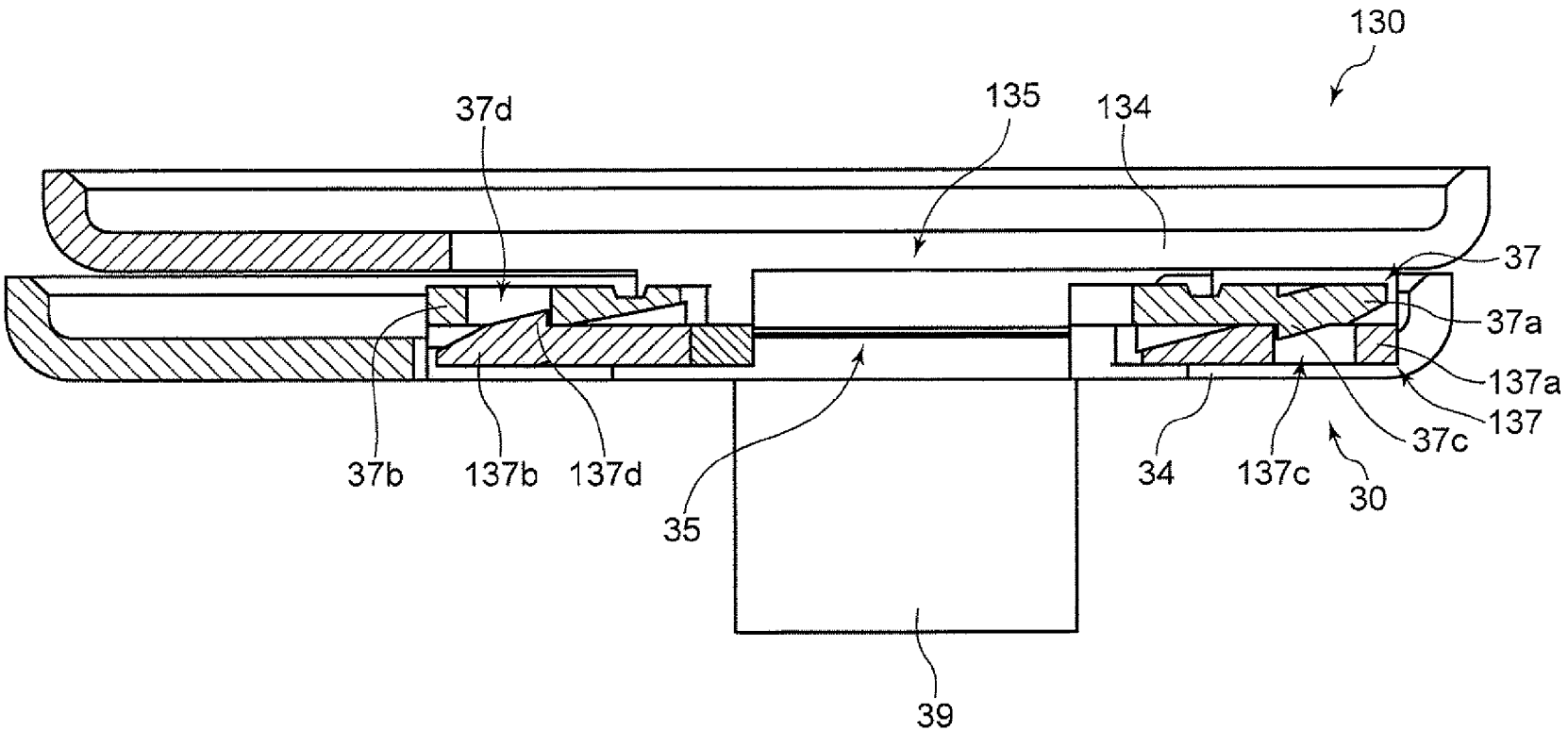
FIG. 4 is a sectional view taken along the line IV-IV in FIG. 3.

For example, as shown in FIG. 4, the second engagement member 137*a* of the upper ground-side terminal portion 134 is inserted just below the first engagement member 37*a* of the lower ground-side terminal portion 34, and a locking protrusion 37*c* formed in the first engagement member 37*a* is fitted into a locking hole 137*c* formed in the second engagement member 137*a*. Simultaneously, the second engagement member 137*b* of the upper ground-side terminal portion 134 is inserted just below the first engagement member 37*b* of the lower ground-side terminal portion 34, and a locking protrusion 137*d* formed in the second engagement member 137*b* is fitted into a locking hole 37*d* formed in the first engagement member 37*b*. The lower and upper ground-side terminal portions 34 and 134 are thus joined to each other, forming the ground connecting device at a terminal end of the wire harness. The locking protrusion and the locking hole may be arranged reversely.

Besides, the first and second connector housings 40 and 140 of the first and second ground joint connectors JC1 and JC2 may also be fixed to each other. For example, respective ones of opposed surfaces of the first and second connector housings 40 and 140 may be provided with concave and convex portions, which are fitted to each other to keep the first and second connector housings 40 and 140 stacked onto each other.

(4) Connection to Ground Site

While keeping the direct contact and the electrical interconnection of the second ground-side terminal portion 134 of the second ground joint connector JC2 and the first ground-side terminal portion 34 of the first ground joint connector JC1, the first and second contact sections of the first and second ground-side terminal portion 34 and 134 are directly and collectively connected to the bolt B of the ground site.

Specifically, as shown in FIG. 5, under the condition of the unitization of the first and second ground joint connectors JC1 and JC2, the tongue piece 39 of the first ground-side terminal portion 34 is inserted into the hole H of the wall surface WS, and positioned. In this state, the fixing surface 34*a* (see FIG. 7) of the first ground-side terminal portion 34 is placed on a region of the wall surface WS around the bolt B which penetrates through the through-holes 35 and 135 provided in the first and second ground-side terminal portions 34 and 134 respectively, and then a non-illustrated nut is screwed onto the bolt B and fastened, thereby fixing the first and second ground-side terminal portions 34 and 134 between the wall surface WS and a head of the bolt B. The first and second grounding wires 11 and 111 are thus collectively connected to the common ground site through the first and second wire terminals 20 and 120 fitted to the first and second wire-side terminal portions 32 and 132 of the first and second grounding conductor 30 and 130, and the first and second ground-side terminal portion 34 and 134 included in the first and second grounding conductor 30 and 130, respectively.

Figure 14:
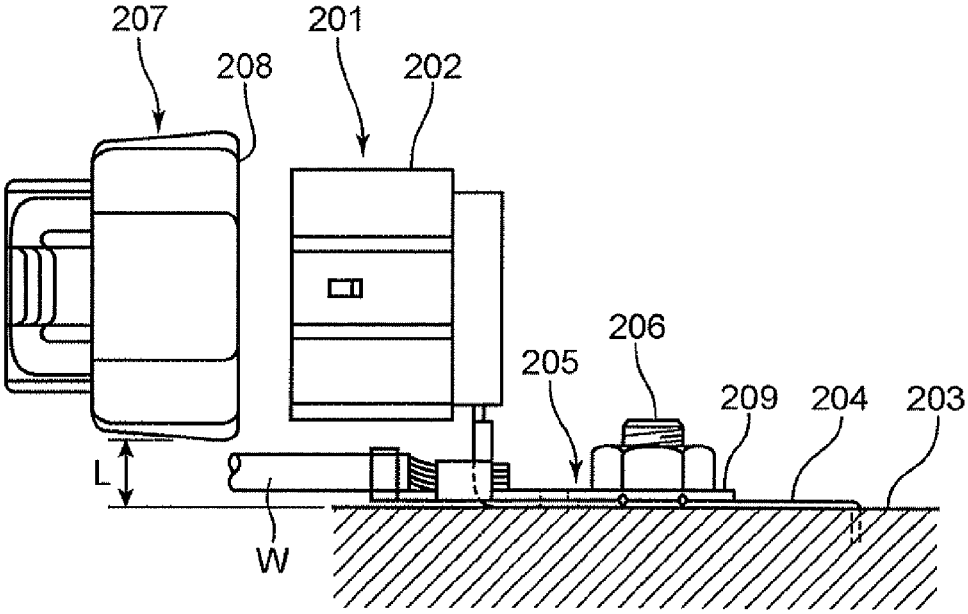
PRIOR ART FIG.14
FIG. 14 is a front view showing a conventional ground connecting device.

The ground connecting device according to the first embodiment does not require another housing, that is, an wire-side housing, because the first and second wire terminals 20 and 120 are directly inserted into the first and second connector housing 40 and 140 respectively to be directly connected to the first and second grounding conductor 30 and 130 respectively. This allows the ground connecting devices to occupy a reduced space as compared with the conventional ground connecting device. Specifically, in the first and second ground joint connectors JC1 and JC2, the first and second wire terminals 20 and 120 attached to the respective terminal ends of the first and second grounding wires 11 and 111 are directly inserted into their respective terminal receiving chambers 44 of the first and second connector housings 40 and 140, and the lances 48 that is terminal locking portions provided in the first and second connector housings 40 and 140 lock the first and second grounding conductor 30 and 130 to keep them fitted to corresponding ones of the first and second wire-side terminal portions 32 and 132 of the first and second grounding conductor 30 and 130 respectively; therefore, the above-mentioned dedicated connector housing 208 for collectively holding the wire terminals as illustrated in FIG. 14 is not required because the first and second wire terminals 20 and 120 can be connected to the ground site through the first and second grounding conductor 30 and 130 based on only the first and second connector housing 40 and 140 holding the first and second grounding conductor 30 and 130 respectively. In addition, the connection can be kept based on the lock of the first and second wire terminals 20 and 120 by the lances 48 of the first and second connector housing 40 and 140. Furthermore, the alignment of the first and second wire-side terminal portions 32 and 132 of the first and second grounding conductors 30 and 130 in a direction approximately parallel to the wall surface WS of the vehicle to which the first and second ground-side terminal portions 34 and 134 is to be fixed enables overall size of the first and second ground joint connector JC1 and JC2 in a direction perpendicular to the alignment direction, i.e., in the stacking direction S, to be set small, which results in a small protruding amount thereof from the wall surface WS.

Moreover, the second grounding conductor 130 and the second connector housing 140, having a structure stackable on the first grounding conductor 30 and the first connector housing 40, allow a large number of electric wires to be collectively connected to the ground site within a limited space. Specifically, the second grounding conductor 130 and the second connector housing 140 have shapes to allow the second grounding conductor 130 to be stacked on the first grounding conductor 30, in such a posture that the alignment direction of the first wire-side terminal portions 32 and the alignment direction of the second wire-side terminal portions 132 are parallel to each other, in a stacking direction S perpendicular to both of the alignment directions, and allow the first connector housing 40 and the second connector housing 140 to be stacked onto each other in the stacking direction S in the stacked state of the first grounding conductor 30 and the second grounding conductor 130; therefore, the stack arrangement of the flat-shaped connector housing 40 and 140 and of the first and second ground-side terminal portions 34 and 134 of the first and second grounding conductors 30 and 130, in the stacking direction S, allow a large number of electric wires to be connected to the ground site, even in a little occupancy space, and enable the ground connecting device to be installed even in a narrow space inside a vehicle.

Besides, the ground connecting device according to the first embodiment, including the direct connection of the first and second grounding conductors 30 and 130 fitted with the first and second wire terminals 20 and 120 respectively to the ground site, allows only an extremely low resistance to exist between each of the grounding wires 11 and 111 and the ground site, which realizes an excellent ground connection. Specifically, the collective connection of the first and second ground-side terminal portion 34 and 134 of the first and second ground joint connectors JC1 and JC2 to the ground site allows a junction portion (splice point) to be set at just the ground site. This prevents a current to be flowed directly between a plurality of adjacent grounding wires bypassing the ground site, thereby suppressing a risk that an on/off action of a certain one of a plurality of units connected to the wire harness gives rise to a potential difference from the remaining units to cause malfunction of the remaining units. This allows the number of electric wires to be grounded to be increased, resulting in an improved quality of the ground connecting device.

Furthermore, the first and second contact sections 37 and 137 formed in the first and second ground-side terminal portions 34 and 134 respectively can electrically interconnect the first and second ground-side terminal portions 34 and 134, when they are stacked onto each other in the stacking direction S, by contact of the contact sections 37 and 137 with each other.

In addition, the first engagement members 37*a* and 37*b* of the first contact section 37 and the second engagement members 137*a* and 137*b* of the second contact section 137 can keep the first and second grounding conductors 30 and 130 stacked to each other, by the engagement thereof with each other. This makes it possible to collectively connect the first and second ground joint connectors JC1 and JC2 to the ground site while integrally unitizing the connectors JC1 and JC2, thereby facilitating an attachment operation of the ground joining device to the ground site and stabilizing the condition of the connection of the ground joining device to the ground site.

In the first embodiment, the stepped portion 136 provided in the second grounding conductor 130 extends in a direction parallel to the stacking direction S at a position between the second ground-side terminal portion 134 and each of the second wire-side terminal portions so as to provide a step between the second ground-side terminal portion 134 and each of the second wire-side terminal portions, in the stacking direction S, and has a size enough to allow the second connector housing 140 to be stacked on the first connector housing 40 when the second ground-side terminal portion 134 is stacked on the first ground-side terminal portion 34; this enables the first and second grounding conductors 30 and 130 to be stacked onto each other and enables the first and second connector housings 40 and 140 to be stacked onto each other, in spite of the shape difference (particularly in thickness) therebetween. Specifically, when the first and second grounding conductors 30 and 130 are integrally unitized by the first and second engagement members 37*a*, 37*b*, 137*a* and 137*b*, the stepped portion 136 in the second grounding conductor 130, extending in the stacking direction S, enables the second connector housing 140 to be fixed at a given position while being stacked on the surface of the first connector housing 40, thereby facilitating an positioning operation of the first and second connector housings 40 and 140 with respect to each other and further improving the attachment operation of the ground joining device to the ground site. In addition, the first wire harness body comprising the first grounding wires 11 and the second wire harness body comprising the second grounding wires 111 are disposed above the wall surface WS while stacked to each other in the stacking direction S similarly to the first and second connector housings 40 and 140; this significantly reduces an occupancy space of the first and second wire harness bodies above the wall surface WS and allows the first and second wire harness bodies to be easily installed even in a narrow space inside a vehicle.

In the ground connecting device according to the first embodiment, the first ground-side terminal portion 34 of the first ground joint connector JC1 and the second ground-side terminal portion 134 of the second ground joint connector JC2 make direct contact with each other, and both of them are electrically connected to the bolt B to be grounded; however, the present invention is not limited to this embodiment.

According to the following second embodiment, provided is a ground connecting device further comprising an electronic component unit 70, as shown in FIGS. 8 to 11, in addition to the components of the ground connecting device according to the first embodiment: the electronic component unit 70 is adapted to be interposed between the first and second ground-side terminal portions 34 and 134 to build a specific circuit between the first and second ground joint connectors JC1 and JC2.

The electronic component unit 70 includes an electronic component 72, a first unit terminal 74, a second unit terminal 73 and an insulation portion 71.

As the electronic component 72 may be selected one suitable for fulfilling a requirement of the circuit. A typical example of the electronic component 72 is a resistor or a coil for building a noise reduction circuit. The electronic component 72 may be a single component, such as a resistor or a coil, or may be a combination of the resistor and the coil connected in parallel or series.

The electronic component 72 has an upper terminal 72*a* and a lower terminal 72*b*. The terminals 72*a* and 72*b* make contact with the second unit terminal 73 and the first unit terminal 74, respectively.

The first unit terminal 74 is adapted to come into contact with the first ground-side terminal portion 34 to thereby electrically interconnect the first ground-side terminal portion 34 and the electronic component 72. Similarly, the second unit terminal 73 is adapted to come into contact with the second ground-side terminal portion 134 to thereby electrically connect the second ground-side terminal portion 134 and the electronic component 72.

The insulating portion 71 is made of an insulating material such as a synthetic resin, molded around the electronic component 72. The insulation portion 71 holds the first and second unit terminals 74 and 73 and the electronic component 72 so as to expose a part of the first unit terminal 74 and a part of the second unit terminal 73 to the outside of the insulation portion 71. The electronic component unit 70 electrically interconnects the first and second ground-side terminal portions 34 and 134, while insulating the second ground-side terminal portion 134 of the second ground joint connector JC2 located on an opposite side of the wall surface WS (on an upper side), from the ground site.

The first unit terminal 74 has two engagement portions 76*a* and 76*b* engageable with the first ground-side terminal portion 34, that is, the lower portion, and the second unit terminal 73 has two engagement portions 75*a* and 75*b* engageable with the second ground-side terminal portion 134, that is, the upper portion. These engagements make an integral unitization of the lower and upper ground-side terminal portions 34 and 134 while interposing the electronic component unit 70 therebetween. Specifically, the engagement portions 76*a* and 76*b* of the first unit terminal 74 engage with the first engagement members 37*a* and 37*b* of the first ground-side terminal portion 34 of the first ground joint connector JC1, i.e., the lower connector, respectively; the engagement portions 75*a* and 75*b* of the second unit terminal 73 engage with the second engagement members 137*a* and 137*b* of the second ground-side terminal portion 134 of the second ground joint connector JC2, i.e., the upper connector, respectively. Furthermore, in order to prevent disengagement of the electronic component unit 70 from the first and second grounding conductors 30 and 130, the engagement portion 75*a* and the engagement portion 76*b* are formed with a locking protrusion 75*c* and a locking protrusion 76*d*, respectively, while the engagement portion 75*b* and the engagement portion 76*a* are formed with a locking hole 75*d* and a locking hole 76*c*, respectively.

In addition, the electronic component unit 70 is formed with a through-hole 79 into which the bolt B can be inserted, the through-hole 79 penetrating through a central region of the electronic component unit 70.

In this electronic component unit 70, the respective engagements of the lower engagement portions 76*a* and 76*b* of the electronic component unit 70 with the first engagement members 37*a* and 37*b* of the first ground joint connector JC1 and the respective engagements of the upper engagement portions 75*a* and 75*b* of the electronic component unit 70 with the second engagement members 137*a* and 137*b* enable the first and second ground joint connectors JC1 and JC2 and the electronic component unit 70 to be unitized with a mutual electrical connection thereof and further to be collectively connected to the bolt B of the ground site while keeping unitized. This facilitates an operation of attaching the entire ground connecting device to the ground site is easy.

The second stepped portion 136 of the second (upper) ground joint connector JC2 according to the second embodiment has a length (height dimension) smaller than that of the second stepped portion 136 according to the first embodiment so as to make a space for the electronic component unit 70 between the lower and upper ground-side terminal portions 34 and 134.

Furthermore, in order to insulate the second ground-side terminal portion 134 of the second ground joint connector JC2 from the ground site, provided is an insulating material (not graphically expressed) such as an insulating sheet so as to cover the upper surface of the second ground-side terminal portion 134 and/or the surface of the bolt B.

The remaining structure is common to that of the ground connecting device according to the first embodiment.

Figure 11:
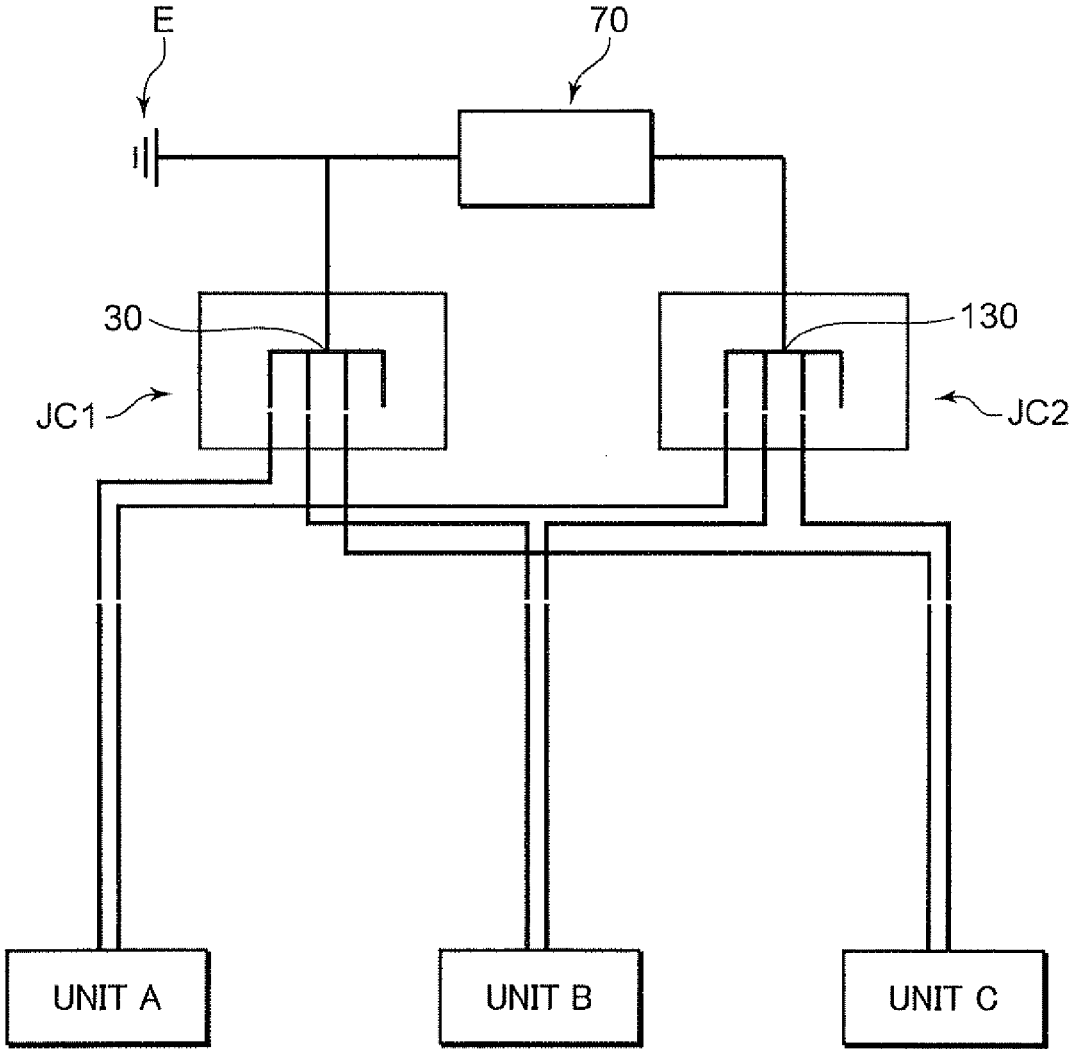
FIG. 11 is a circuit diagram of the ground connecting device in FIG. 8.

Using the above ground connecting device according to the second embodiment makes it possible to build an electric circuit, for example, the circuit as shown in FIG. 11, that is, a circuit for directly connecting a plurality of units A, B and C to a common ground site E through the first grounding conductor 30 of the first (lower) ground joint connector JC1 and to the ground site E via the second grounding conductor 130 of the second (upper) ground joint connector JC2 and the electronic component unit 70 designed for noise-reduction or the like. In this circuit, the electronic component unit 70, interposed between the first and second ground joint connectors JC1 and JC2 and provided on the ground side, can reduce a risk of a noise current flow between the first and second ground joint connectors JC1 and JC2. This type of ground connecting device can be suitably used, for example, for a junction (splice junction) of a CAN (Controller Area Network) circuit.

The electronic component unit 70, interposed between the first and second ground-side terminal portions 34 and 134 to be stacked onto each other for ground connection, makes it possible to build a desired electronic circuit including the electronic component 72 of the electronic component unit 70 without markedly increasing the size of the entire ground connecting device. In addition, the interconnection of the electronic component unit 70 and the grounding conductors 30 and 130 requires no electric wires, which promotes a reduction in production cost.

The electronic component 72 included in the electronic component unit 70 can be easily electrically connected to the first and second ground-side terminal portions 34 and 134 through the first and second unit terminals 74 and 73. Moreover, the insulation portion 71 molded around the electronic component 72 is capable of preventing the electronic component 72 from contact with external foreign substances, etc., thus securing the stability of the electronic circuit.

As the electronic component 72 included in the electronic component unit 70, there may be employed various types of electronic components according to a requirement of a circuit: for example, an electronic component other than the resistor and the coil may be employed.

Figure 12:
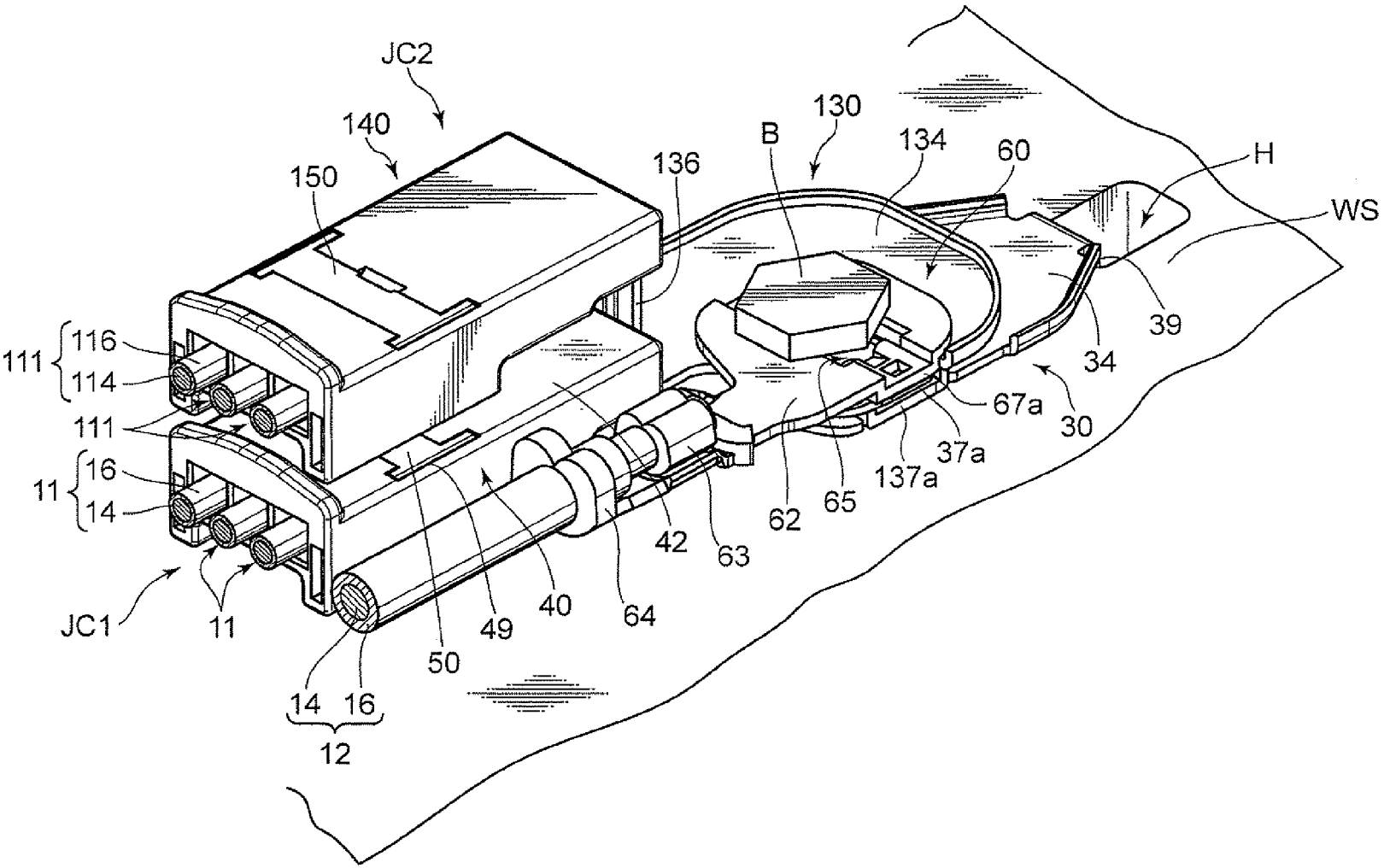
FIG. 12 is a perspective view showing a ground connecting device according to a third embodiment of the present invention.
Figure 13:
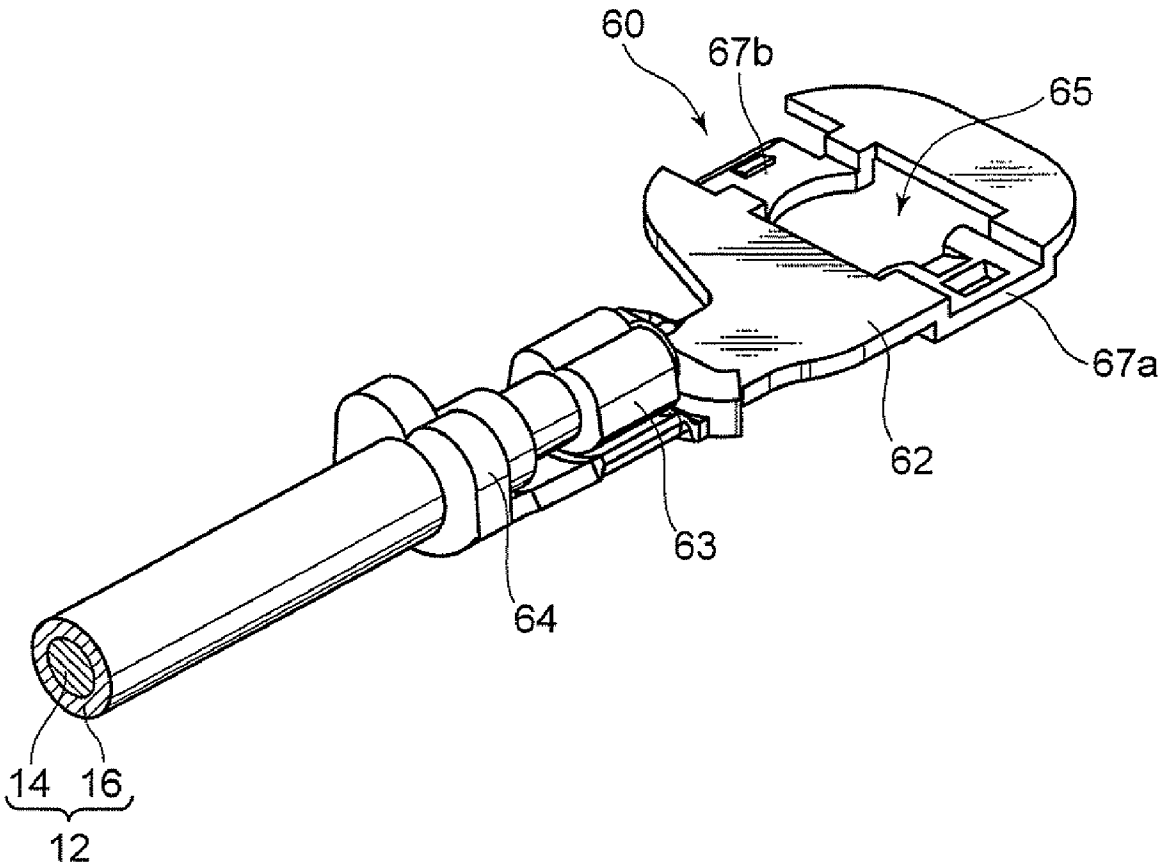
FIG. 13 is a perspective view of an external grounding connection wire and an external grounding terminal in FIG. 12.

FIGS. 12 and 13 show a ground connection device according to a third embodiment of the present invention. While the ground joint connectors JC1 and JC2 according to the first and second embodiments make connection of the wire harness to the ground site, the ground connection device according to the third embodiment is designed to connect, in addition to the above connection, an extra single line, namely, external grounding wire 12, to the ground. The external grounding wire 12 is a fail-safe one for connecting, in the case of the grounding failure due to the occurrence of damage or the like in the ground site, the ground site to another ground site. The external grounding wire 12 has an outer diameter greater than that of each of the first and second grounding wires 11 and 111, in order to secure a large current capacity. The external grounding wire 12 has opposite ends, one of which is connected to the ground site and the other is connected to another ground site.

Specifically, the ground connection device according to the third embodiment comprises, in addition to the first and second ground joint connectors JC1 and JC2, an external ground terminal 60 as shown in FIGS. 12 and 13, which is attached to a terminal end of the external grounding wire 12. The external ground terminal 60 includes a wire-side fixed portion, which is adapted to be fixed onto the terminal end of the external grounding wire 12, and a terminal body portion 62.

The wire-side fixed portion has a pair of conductor barrels 63 and a pair of insulation barrels 64. The conductor barrels 63 are crimped onto a conductor 14 of the external grounding wire 12 so as to enfold the conductor 14. The insulation barrels 64 are crimped onto an insulation cover 16 of the external grounding wire 12 so as to enfold the insulating sheath 16.

The terminal body portion 62 is held at a position for being superimposed on the first and second ground-side terminal portions 34 and 134 of the first and second grounding conductors 30 and 130 outside the first and second connector housings 40 and 140. Specifically, the terminal body portion 62 is formed with a through-hole 65 at a position to be aligned with the through-holes 35 and 135 of the first and second ground-side terminal portions 34 and 134, and adapted to be fastened by the bolt B inserted into the through-holes 35, 135 and 65 while making contact with the upper surface of the second ground-side terminal portion 134 of the (upper) second ground joint connector JC2, thus grounded.

In the ground connection device according to the third embodiment, the external grounding terminal 60 is stacked together with the first and second ground-side terminal portions 34 and 134 of the first and second ground joint connectors JC1 and JC2 and collectively connected to the bolt B of the ground site together with the ground-side terminal portions 34 and 134; therefore, the entire ground connecting device, though comprising the external ground terminal 60, occupies only a little space and can be easily installed even in a limited space inside a vehicle. Besides, the position of the external ground terminal 60 close to the ground site deters a problem of a direct current flow between the external grounding wire and the wire harness bypassing the ground site, thus effectively suppressing the occurrence of equipment malfunction due to the current flow.

Further, differently from the aforementioned conventional device illustrated in FIG. 14, the ground connecting device according to the third embodiment allows the external grounding wire 12 to be disposed adjacent to and on a lateral side of the first connector housing 40 of the first ground joint connector JC1, i.e., aligned with the first grounding wires 11 in a direction parallel to the alignment direction of the first wire-side terminal portions 32: this enables the entire device to be flat-shaped despite the addition of the external grounding wire 12 to thereby suppress an amount of the protrusion of the device from the wall surface of the vehicle.

Although not included in the present invention, it is possible to omit the second ground joint connector JC2, i.e., the upper connector, and connect the external ground terminal 60 to the first ground-side terminal portion 34 of the first ground joint connector JC1, i.e., the upper connector. Specifically, the terminal body portion 62 in the third embodiment may be provided with an engagement section 67*a* and an engagement section 67*b* engageable with the engagement member 37*a* and the engagement member 37*b* of the first ground joint connector JC1, respectively. Such an omission of the (upper) second ground joint connector JC2 and the respective engagement of the engagement section 67*a* and 67*b* with the lower engagement member 37*a* and 37*b* allows the external ground terminal 60 to be held on the surface of the first ground-side terminal portion 34 of the first ground joint connector JC1.

The present invention is not intend to exclude that the ground connecting device comprises three or more ground joint connectors including the above first and second joint connectors.

(Outline of the Invention)

As above-mentioned, the present invention provides a ground connecting device comprising a ground joint connector for connecting a wire harness to a ground site while occupying only a little space, and a wire harness having the ground connecting device.

Specifically, the present invention provides a ground connecting device for collectively connecting a group of grounding wires to a ground site provided in a wall surface inside a vehicle. The ground connecting device comprises a first ground joint connector to be provided at terminal ends of a plurality of first ones of the grounding wires and a second ground joint connector to be provided at terminal ends of a plurality of second ones of the remaining grounding wires.

The first ground joint connector comprises: a plurality of first wire terminals to be attached to the terminal ends of the first grounding wires respectively; a first grounding conductor which includes a plurality of first wire-side terminal portions each having a shape capable of being fitted to a corresponding one of the first wire terminals in a specific terminal fitting direction common to the first wire terminals, and a first ground-side terminal portion having a shape capable of being connected to the ground site on the wall surface, the first wire-side terminal portions being aligned in a direction approximately perpendicular to the terminal fitting direction and approximately parallel to the wall surface and integrally joined to the first ground-side terminal portion and; a first connector housing which holds the first grounding conductor, the first connector housing including a plurality of terminal receiving chambers and a plurality of terminal locking portions. Each of the terminal receiving chambers has an opening oriented in one direction parallel to the terminal fitting direction and receives the first wire terminals inserted through the opening thereof. Each of the terminal locking portions is adapted to lock the first wire terminal inserted into a corresponding one of the terminal receiving chambers. The first connector housing receives the first wire-side terminal portions in the terminal receiving chambers respectively so as to allow each of the terminal locking portions to lock a corresponding one of the first wire terminals which are inserted into the receiving chambers and fitted with the first wire-side terminal portions respectively, and holds the first grounding conductor in such a manner that the first ground-side terminal portion protrudes outside the first connector housing on a side opposite to the openings of the terminal receiving chambers of the first connector housing.

The second ground joint connector comprises: a plurality of second wire terminals to be attached to the terminal ends of the second grounding wires respectively; a second grounding conductor which includes a plurality of second wire-side terminal portions each having a shape capable of being fitted to a corresponding one of the second wire terminals in a specific terminal fitting direction common to the second wire terminals, and a second ground-side terminal portion having a shape capable of being connected to the ground site on the wall surface, the second wire-side terminal portions being aligned in a direction approximately perpendicular to the terminal fitting direction and approximately parallel to the wall surface and integrally joined to the second ground-side terminal portion and; a second connector housing which holds the second grounding conductor, the second connector housing including a plurality of terminal receiving chambers and a plurality of terminal locking portions. Each of the terminal receiving chambers has an opening oriented in one direction parallel to the terminal fitting direction so that each of the second wire terminals can be inserted into a corresponding one of the terminal receiving chambers through the opening thereof. Each of the terminal locking portions is adapted to lock the second wire terminal inserted into a corresponding one of the terminal receiving chambers. The second connector housing receives the second wire-side terminal portions in the terminal receiving chambers respectively so as to allow each of the terminal locking portions to lock a corresponding one of the second wire terminals which are inserted into the receiving chambers and fitted with the second wire-side terminal portions respectively, and holds the second grounding conductor in such a manner that the second ground-side terminal portion protrudes outside the second connector housing on a side opposite to the openings of the terminal receiving chambers of the second connector housing.

The second ground-side conductor and the second connector housing have respective shapes to allow the second grounding conductor and the first grounding conductor to be stacked onto each other, under a condition that a first alignment direction of the first wire-side terminal portions and a second alignment direction of the second wire-side terminal portions are approximately parallel to each other, in a stacking direction perpendicular to both of the alignment directions and allowing the first connector housing and the second connector housing to be stacked onto each other in the stacking direction in a state that the first grounding conductor and the second grounding conductor are stacked onto each other.

The ground connecting device according to the present invention requires no extra housing on the wire-side, because the first and second wire terminals are directly inserted into the first and second connector housing respectively and connected to the first and second grounding conductor respectively. This enables the device to occupy only a little space as compared with the conventional ground connecting device.

Specifically, in each of the first and second ground joint connectors, the first (second) wire terminals attached to the respective terminal ends of the first (second) grounding wires are directly inserted into their respective terminal receiving chambers of the first (second) connector housing holding the first (second) grounding conductor to be fitted to the first (second) wire-side terminal portions of the first (second) grounding conductor respectively, and locked by the respective terminal locking portions provided in the first (second) connector housing, thus keeping their fitted state. This device, not requiring the aforementioned dedicated connector housing for collectively holding the wire terminals as shown in FIG. 14, can connect the first (second) wire terminals to the ground site through the first (second) grounding conductor and locked by the terminal locking portions of the first (second) connector housing, based on only the first (second) connector housing holding the first (second) grounding conductor. Furthermore, the alignment of the first (second) wire-side terminal portions of the first (second) grounding conductor, in a direction approximately parallel to the wall surface of the vehicle to which the first (second) ground-side terminal portion is to be fixed, reduces the size of the first (second) ground joint connector in a direction perpendicular to the alignment direction, i.e., in the stacking direction, thus reducing a protruding amount thereof from the wall surface.

Furthermore, the respective stacks of the second grounding conductor and the second connector housing to the first grounding conductor and the first connector housing allows a large number of electric wires to be collectively connected to the ground site even in a limited space.

Specifically, the second grounding conductor and the second connector housing have respective shapes to allow the second grounding conductor to be stacked onto the first grounding conductor, in such a posture that the two alignment directions of the first and second wire-side terminal portions are parallel to each other, in a stacking direction perpendicular to both of the alignment directions, and allow the first connector housing and the second connector housing to be stacked onto each other in the stacking direction, while the first and second grounding conductors are stacked onto each other. The stack of the first and second connector housings and the stack of the first and second ground-side terminal portions enable a lot of the wires to be directly connected to the ground site while allowing the device to occupy a little space and to be easily installed even in a limited space inside the vehicle.

Besides, the direct connection of the first and second grounding conductors fitted with the wire terminals to the ground site remains almost no resistance between each of the first and second grounding wires and the ground site, resulting in an excellent ground connection. For example, in the case of collectively connecting a large number of grounding wires included in a wire harness to a ground site by use of the connector described in the JP 10-208815A, a junction (splice point) of the grounding wires is required to be positioned far from the ground site because of a restricted space around the ground site: this arrangement can involve a problem of a direct current flow between adjacent ones of the grounding wires bypassing the ground site. On contrast, the ground connecting device according to the present invention allows the first and second ground-side terminal portions of the first and second joint connectors to be collectively and directly connected to the ground site, thus enabling the junction (splice point) to be set just at the ground site. This deters a problem of a direct current flow between grounding wires adjacent to each other bypassing the ground site, thereby inhibiting a risk that an on/off action of a certain one of a plurality of units connected to the wire harness gives rise to a potential difference from the remaining units to cause malfunction of the remaining units, resulting in an increase of the number of the electric wires which can be connected to the common ground site and the improved quality of the ground connecting device.

The first and second ground-side terminal portions preferably have first and second contact sections respectively, the first and second contact sections being adapted to make contact with each other, when the first and second ground-side terminal portions are stacked onto each other in the stacking direction, to allow the first and second ground-side terminal portions to be electrically conducted to each other. This allows the first and second ground-side terminal portions to make contact with each other through the first and second contact sections while stacked onto each other in the stacking direction to thereby be electrically conducted to each other.

More preferably, the first contact section includes a first engagement member, and the second contact section includes a second engagement member adapted to engage with the first engagement member, when the first and second grounding conductors are stacked onto each other, to keep the stack of the first and second grounding conductors. The engagement of the first and second engagement members, keeping the stack of the first and second conductors, enables the first and second joint connectors to be collectively connected to the ground site while being integrally united, thus facilitating an operation for attachment of the first and second joint connectors to the ground site. Besides, this stabilizes the connection of the joint connectors to the ground site.

It is also preferable that the second grounding conductor includes a stepped portion extending in a direction parallel to the stacking direction at a position between the second ground-side terminal portion and each of the second wire-side terminal portions to thereby provide a step between the second ground-side terminal portion and each of the second wire-side terminal portions in the stacking direction, the stepped portion having a size enough to allow the second connector housing to be stacked on the first connector housing when the second ground-side terminal portion is stacked on the first ground-side terminal portion. The stepped portion enables both of the stack of the first and second grounding conductors and the stack of the first and second connector housings to be simultaneously performed, in spite of a shape difference (particularly, a difference in thickness) between the ground conductors and the connector housing. Specifically the stepped portion extending in the stacking direction in the second grounding conductor of the second ground joint connector allows the second connector housing of the second ground joint connector to be located at a given position for being stacked on the surface of the first connector housing of the first ground joint connector, when the first and second grounding conductors are integrally unitized by the first and second engagement members. This eliminates the need for relative positioning of the first and second ground connector housings, thus further improving an operation for attachment of the ground joining device to the ground site.

Preferably, the ground connecting device of the present invention further comprises an electronic component unit interposable between the first ground-side terminal portion and the second ground-side terminal portion in a state that the first and second ground-side terminal portions are connected to the ground site, the electronic component unit having an electronic component to built an electronic circuit including the electronic component between the first and second ground-side terminal portions. In this ground connecting device, interposing the electronic component unit between the first and second ground-side terminal portions to be stacked to each other for ground connection makes it possible to introduce a desired electronic circuit into the ground connecting device without requiring significantly increased space. In other words, it becomes possible to build a ground connecting device incorporating an electronic circuit while avoiding a significant increase in occupancy space. In addition, there is no need for an electric wire to interconnect the electronic component unit and each of the first and second grounding conductors, which results in a reduced production cost.

More preferably, the electronic component unit includes: a first unit terminal adapted to make contact with the first ground-side terminal portion to thereby electrically interconnect the first ground-side terminal portion and the electronic component; a second unit terminal adapted to make contact with the second ground-side terminal portion to thereby electrically interconnect the second ground-side terminal portion and the electronic component; and an insulation portion made of an insulating material and molded around the electronic component, the insulation portion holding the first and second unit terminals and the electronic component so as to expose a part of the first unit terminal and a part of the second unit terminal to an outside of the insulation portion. The electronic component included in this electronic component unit can be electrically connected to the first and second ground-side terminal portions through the first and second unit terminals. Besides, the insulation portion molded around the electronic component prevents the electronic component from contact with external foreign substances, etc., thereby improving stability of the electronic circuit.

Preferably, the ground connecting device of the present invention further comprises an external grounding terminal attached to a terminal end of an external grounding wire other than the first grounding wires and the second grounding wires, wherein the external grounding terminal is disposed so as to be stacked together with the first ground-side terminal portion and the second ground-side terminal portion. The thus disposed external grounding terminal can be collectively connected to the ground site while be superimposed on with the first and second ground-side terminal portions. This allows the entire device to occupy a reduced space and thereby be easily installed even in a limited space inside a vehicle. In addition, the external ground terminal can be disposed close to the ground site, which inhibits a problem of a current flow between the external grounding wire and the wire harness bypassing the ground site and the occurrence of malfunction of a unit.

The present invention also provides a wire harness having the above ground connecting device. The wire harness comprises a first wire harness body including a plurality of first grounding wires, a second wire harness body including a plurality of second grounding wires, and the above ground connecting device. The first wire terminals comprised in the first ground joint connector of the ground connecting device are inserted into the respective terminal receiving chambers of the first connector housing of the ground joint connector and fitted to the respective first wire-side terminal portions, while being attached to respective terminal ends of the first grounding wires of the first wire harness body; the second wire terminals comprised in the second ground joint connector of the ground connecting device are inserted into the respective terminal receiving chambers of the second connector housing of the ground joint connector and fitted with the respective second wire-side terminal portions, while being attached to respective terminal ends of the second grounding wires of the second wire harness body. In addition, the second ground-side conductor and the second connector housing have respective shapes to allow the first connector housing and the second connector housing to be stacked on each other in the stacking direction under a condition that the first wire harness body and the second wire harness body are stacked with respect to each other.

According to this wire harness, the first and second wire harnesses, being disposed so as to be stacked on each other similarly to the first and second connector housings, occupy only a limited space.

This application is based on Japanese Patent application No. 2010-122305 filed in Japan Patent Office on May 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A ground connecting device for collectively connecting a group of grounding wires including a plurality of first grounding wires and a plurality of second grounding wires to a common ground site provided in a wall surface inside a vehicle, comprising:

a first ground joint connector to be provided at respective terminal ends of the first grounding wires; and a second ground joint connector to be provided at respective terminal ends of the second grounding wires, wherein the first ground joint connector comprises:

a plurality of first wire terminals to be attached to the terminal ends of the first grounding wires respectively;

a first grounding conductor which includes a plurality of first wire-side terminal portions having respective shapes capable of being fitted to the first wire terminals respectively in a specific common terminal fitting direction and a first ground-side terminal portion having a shape capable of being connected to the ground site on the wall surface, the first wire-side terminal portions being aligned in a direction approximately perpendicular to the terminal fitting direction and approximately parallel to the wall surface and integrally joined to the first ground-side terminal portion; and a first connector housing which holds the first grounding conductor and includes a plurality of terminal receiving chambers each having an opening oriented in one direction parallel to the terminal fitting direction and receiving the first wire terminal inserted to the terminal receiving chamber through the opening thereof, and a plurality of terminal locking portions adapted to lock the first wire terminals inserted into the respective terminal receiving chambers respectively, the first connector housing receiving the first wire-side terminal portions in the terminal receiving chambers respectively so as to allow each of the terminal locking portions to lock a corresponding one of the first wire terminals which are inserted into the receiving chambers and fitted with the first wire-side terminal portions respectively, and holds the first grounding conductor in such a manner that the first ground-side terminal portion protrudes outside the first connector housing on a side opposite to the openings of the terminal receiving chambers of the first connector housing, and the second ground joint connector comprises:

a plurality of second wire terminals to be attached to the terminal ends of the second grounding wires respectively;

a second grounding conductor which includes a plurality of second wire-side terminal portions having respective shapes capable of being fitted to the second wire terminals respectively in a specific common terminal fitting direction and a second ground-side terminal portion having a shape capable of being connected to the ground site on the wall surface, the second wire-side terminal portions being aligned in a direction approximately perpendicular to the terminal fitting direction and approximately parallel to the wall surface and integrally joined to the second ground-side terminal portion; and a second connector housing which holds the second grounding conductor and includes a plurality of terminal receiving chambers each having an opening oriented in one direction parallel to the terminal fitting direction and receiving the second wire terminal inserted to the terminal receiving chamber through the opening thereof, and a plurality of terminal locking portions adapted to lock the second wire terminals inserted into the respective terminal receiving chambers respectively, the second connector housing receiving the second wire-side terminal portions in the terminal receiving chambers respectively so as to allow each of the terminal locking portions to lock a corresponding one of the second wire terminals which are inserted into the receiving chambers and fitted with the second wire-side terminal portions respectively, and holds the second grounding conductor in such a manner that the second ground-side terminal portion protrudes outside the second connector housing on a side opposite to the openings of the terminal receiving chambers of the second connector housing, and wherein the second grounding conductor and the second connector housing have respective shapes to allow the second grounding conductor and the first grounding conductor to be stacked onto each other, under a condition that a first alignment direction of the first wire-side terminal portions and a second alignment direction of the second wire-side terminal portions are approximately parallel to each other, in a stacking direction perpendicular to both of the alignment directions, and allow the first connector housing and the second connector housing to be stacked onto each other in the stacking direction in a state that the first grounding conductor and the second grounding conductor are stacked onto each other.

2. The ground connecting device as defined in claim 1, wherein the first ground-side terminal portion has a first contact section, and the second ground-side terminal portion has a second contact section, the first and second contact sections being adapted to make contact with each other, when the first and second ground-side terminal portions are stacked on each other in the stacking direction, to thereby allow the first and second ground-side terminal portions to be electrically conducted to each other.

3. The ground connecting device as defined in claim 2, wherein the first contact section includes a first engagement member, and the second contact section includes a second engagement member adapted to engage with the first engagement member, when the first and second grounding conductors are stacked with respect to each other, to thereby keep the first and second grounding conductors stacked on each other.

4. The ground connecting device as defined in claim 1, wherein the second grounding conductor includes a stepped portion extending in a direction parallel to the stacking direction at a position between the second ground-side terminal portion and each of the second wire-side terminal portions to thereby provide a step between the second ground-side terminal portion and each of the second wire-side terminal portions, in the stacking direction, the stepped portion having a size to allow the second connector housing to be stacked on the first connector housing when the second ground-side terminal portion is stacked on the first ground-side terminal portion.

5. The ground connecting device as defined in claim 1, which further comprises an electronic component unit interposable between the first ground-side terminal portion and the second ground-side terminal portion in a state that the first and second ground-side terminal portions are connected to the ground site, the electronic component unit having an electronic component and being adapted to build an electronic circuit including the electronic component, between the first and second ground-side terminal portions.

6. The ground connecting device as defined in claim 5, wherein the electronic component unit includes:

a first unit terminal adapted to make contact with the first ground-side terminal portion to thereby electrically interconnect the first ground-side terminal portion and the electronic component;

a second unit terminal adapted to make contact with the second ground-side terminal portion to thereby electrically interconnect the second ground-side terminal portion and the electronic component; and an insulation portion made of an insulating material and molded around the electronic component, the insulation portion holding the first and second unit terminals and the electronic component so as to expose a part of the first unit terminal and a part of the second unit terminal to an outside of the insulation portion.

7. The ground connecting device as defined in claim 1, which further comprises an external grounding terminal attached to a terminal end of an external grounding wire other than the first grounding wires and the second grounding wires, the external grounding terminal being disposed so as to be stacked together with the first ground-side terminal portion and the second ground-side terminal portion.

8. A wire harness to be provided in a vehicle, comprising:

a first wire harness body including a plurality of first grounding wires;

a second wire harness body including a plurality of second grounding wires; and the ground connecting device as defined in claim 1, wherein:

the first wire terminals comprised in the first ground joint connector of the ground connecting device are inserted into the respective terminal receiving chambers of the first connector housing of the ground joint connector and fitted with the respective first wire-side terminal portions inside the first connector housing, while being attached to respective terminal ends of the first grounding wires of the first wire harness body;

the second wire terminals comprised in the second ground joint connector of the ground connecting device are inserted into the respective terminal receiving chambers of the second connector housing of the ground joint connector and fitted with the respective second wire-side terminal portions inside the second connector housing, while being attached to respective terminal ends of the second grounding wires of the second wire harness body; and the second ground-side conductor and the second connector housing have respective shapes to allow the first connector housing and the second connector housing to be stacked in the stacking direction, under a condition that the first wire harness body and the second wire harness body are stacked on each other.

* * * * *